United States Patent [19]

Hirano et al.

[11] Patent Number: 4,937,179

[45] Date of Patent: Jun. 26, 1990

[54] SILVER HALIDE COLOR PHOTOGRAPHIC MATERIAL

[75] Inventors: Tsumoru Hirano; Kei Sakanoue, both of Kanagawa, Japan

[73] Assignee: Fuji Photo Film Co., Ltd., Kanagawa, Japan

[21] Appl. No.: 866,833

[22] Filed: May 27, 1986

[30] Foreign Application Priority Data

May 27, 1985 [JP] Japan ..... 60-113596
Dec. 15, 1985 [JP] Japan ..... 60-281295

[51] Int. Cl.[5] ..... G03C 7/384

[52] U.S. Cl. ..... 430/544; 430/548; 430/555; 430/957

[58] Field of Search ..... 430/548, 546, 544, 957, 430/555

[56] References Cited

U.S. PATENT DOCUMENTS 4,477,563 10/1984 Ichijima et al. ..... 430/544
4,500,634 2/1985 Sakanoue et al. ..... 430/544
4,745,048 5/1988 Kishimoto et al. ..... 430/376

FOREIGN PATENT DOCUMENTS 1043747 3/1986 Japan ..... 430/544

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide color photographic material comprising a support having thereon a silver halide emulsion layer, wherein the silver halide color photographic material contains a two-equivalent magenta polymer coupler which is capable of forming a color image upon coupling with an oxidation product of an aromatic primary amine developing agent and has an oil pKa′ of 8.0 or more.

The two-equivalent magenta polymer coupler has an excellent color forming property, an improved conversion efficiency to a dye and an improved resistivity to decreases in color forming property upon the attack of chemical substances and is free from the formation of undesirable fog when preserved under conditions of high temperature or of high temperature and high humidity.

The silver halide color photographic material has a reduced layer thickness and an improved sharpness.

The silver halide color photographic material may further contain a hydrolizable type DIR coupler or a non-hydrolizable type DIR coupler which is represented by the following general formula (I):

$$A—(L_1)_a—Z_1 \quad (I)$$

wherein A represents a component capable of releasing $—(L_1)_a—Z_1$ upon a reaction with an oxidation product of a color developing agent; $L_1$ represents a timing group; $Z_1$ represents a development inhibiting component which is not deactivated upon hydrolysis; and a represents 0 or 1, in order to reduce fog due to preservation for a long period of time.

23 Claims, No Drawings

SILVER HALIDE COLOR PHOTOGRAPHIC MATERIAL

FIELD OF THE INVENTION

The present invention relates to a silver halide color photographic material containing a novel magenta color image forming two-equivalent polymer coupler capable of coupling with an oxidation product of an aromatic primary amine developing agent.

BACKGROUND OF THE INVENTION

It is well known that for the color development of a silver halide photographic material, after exposure to light, an oxidized aromatic primary amine developing agent can be reacted with a dye forming coupler to form a color image. In this procedure, the subtractive color process is ordinarily used for color reproduction, and in order to reproduce blue, green and red color images of yellow, magenta and cyan are formed. The colors of the color images are respectively the complementary colors of blue, green and red.

Couplers of the pyrazolone, pyrazolotriazole, pyrazolobenzimidazole, cyanoacetophenone or indazolone type are generally used for forming magenta color images.

It is required in a multilayer color photographic light-sensitive material that couplers are fixed in respective layers separated from each other in order to reduce color mixing and improve color reproduction.

One method for rendering a coupler diffusion-resistant is to utilize a polymer coupler obtained by polymerization of a monomer coupler. As a method of adding a polymer coupler in a latex form to a hydrophilic colloid composition, a method in which a latex prepared by an emulsion polymerization method is directly added to a gelatine silver halide emulsion and a method in which an oleophilic polymer coupler obtained by polymerization of a monomer coupler is dispersed in a latex form in an aqueous gelatin solution have been heretofore known. Some examples of the former emulsion polymerization methods include an emulsion polymerization method in an aqueous gelatin phase as described in U.S Pat. No. 3,370,952 and an emulsion polymerization method in water as described in U.S. Pat. No. 4,080,211. An example of the latter method in which a oleophilic polymer coupler is dispersed in a latex form in gelatin is described in U.S. Pat. No. 3,451,820.

The method of adding a polymer coupler in a latex form to a hydrophilic colloid composition has many advantages in comparison with other methods. First of all, the deterioration of strength of the film formed is prevented, because the hydrophobic substance is in a latex form. Also, since the latex can contain coupler monomers in a high concentration, it is easy to incorporate couplers in a high concentration into a photographic emulsion, and the increase of viscosity is small. Furthermore, color mixing is prevented, since a polymer coupler is completely immobilized and the precipitation of couplers in the emulsion layer is small.

The addition of magenta polymer couplers in a latex form to a gelatino silver halide emulsion, are described, for example, in U.S. Pat. No. 4,080,211, British Pat. No. 1,247,688, U.S. Pat. Nos. 3,451,802 and 3,926,436 and West German Pat. No. 2,725,591, etc.

However, these polymer coupler latexes have a number of problems which need to be eliminated, in addition to the many advantages described above. The problems include the following:

1. The rate of the coupling reaction is poor and thus the density of dye formed is very low.
2. Undesirable fog is readily formed upon color development.
3. The fastness to humidity and heat of the color image is inferior.
4. The resistivity to formalin is very poor. The term "resistivity to formalin" as used herein means a resistivity to degradation in the color forming property of couplers due to formalin gas generated from furniture, etc.

More particularly, they have major disadvantages in coupling reactivity and resistivity to formalin. With respect to the coupling reactivity, no improvement is obtained by using the two-equivalent magenta polymer coupler latex described in West German Pat. No. 2,725,591 and U.S. Pat. No. 3,926,436. Although some degree of improvement in the color forming property is achieved with a two-equivalent magenta polymer coupler latex as described in Japanese patent application (OPI) No. 94752/82 (the term "OPI" as used herein means an "unexamined published application"), the color forming property is generally low in comparison with low molecular weight two-equivalent magenta couplers and they are apt to form undesirable fog upon color development when preserved under conditions of high temperature or of high temperature and high humidity.

SUMMARY OF THE INVENTION

Therefore, an object of the present invention is to provide a color photographic light-sensitive material containing a novel two-equivalent magenta polymer copolyer which has an excellent color forming property.

Another object of the present invention is to provide a color photographic light-sensitive material containing a novel two-equivalent magenta polymer coupler which is free from the formation of undesirable fog upon color development when preserved under conditions of high temperature or of high temperature and high humidity.

A further object of the present invention is to provide a color photographic light-sensitive material containing a novel two-equivalent magenta polymer coupler which have an improved conversion efficiency to a dye and an improved resistivity to decreases in the color forming property upon the attack of chemical substances.

A still further object of the present invention is to provide a silver halide color photographic material having a reduced layer thickness and improved sharpness.

Other objects of the present invention will be apparent from the following detailed description and examples.

These objects of the present invention are accomplished by a silver halide color photographic material comprising a support having thereon a silver halide emulsion layer, wherein the silver halide color photographic material contains a two-equivalent magenta polymer coupler which is capable of forming a color image upon coupling with an oxidation product of an aromatic primary amine developing agent and has an oil pKa' of 8.0 or more.

In another embodiment of the present invention, the silver halide color photographic material further contains a hydrolizable type DIR coupler.

In still another embodiment of the present invention, the silver halide color photographic material further contains a non-hydrolizable type DIR coupler which is represented by the following general formula (I):

$$A-(L_1)_a-Z_1 \quad (I)$$

wherein A represents a component capable of releasing $-(L_1)_a-Z_1$ upon a reaction with an oxidation product of a color developing agent; $L_1$ represents a timing group; $Z_1$ represents a development inhibiting component which is not deactivated upon hydrolysis; and a represents 0 or 1.

DETAILED DESCRIPTION OF THE INVENTION

The term "oil pKa'" as used in the present invention means a value which is obtained by the following method. A polymer coupler containing 0.15 mmol of a monomer coupler was dissolved in 2.4 ml of tri-n-butyl phosphate, to the solution was added 9 ml of an aqueous solution containing 0.5M/l of potassium chloride and the resulting mixture was titrated with a 0.5N aqueous solution of potassium hydroxide while stirring under a nitrogen atmosphere, and pH at the central point of the turning point was determined as the oil pKa'. For the measurement of the oil pKa', a titration apparatus of HTM-104 type manufactured by Toa Dempa Co. was employed.

A monomer coupler which constitutes the two-equivalent magenta polymer coupler used in the present invention is preferably represented by the following general formula (II):

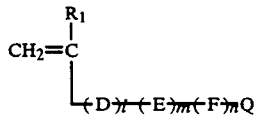

(II)

wherein $R_1$ represents a hydrogen atom, an alkyl group containing from 1 to 4 carbon atoms or a chlorine atom; D represents —COO—, —$CONR_2$— or a substituted or unsubstituted phenyl group; E represents a substituted or unsubstituted alkylene group, a substituted or unsubstituted phenylene group or a substituted or unsubstituted aralkylene group; F represents —$CONR_2$—, —$NR_2CONR_2$—, —$NR_2COO$—, —$NR_2CO$—, —O-$CONR_2$—, —$NR_2$—, —COO—, —OCO—, —CO—, —O—, —S—, —$SO_2$—, —$NR_2SO_2$— or —$SO_2NR_2$—; $R_2$ represents a hydrogen atom, a substituted or unsubstituted aliphatic group or a substituted or unsubstituted aryl group, and when two or more $R_2$'s are present in the same molecule, they may be the same or different; l, m and n each represents 0 or 1, provided that all of l, m and n are not 0 at the same time; and Q represents a coupler residue of a two-equivalent 2-pyrazolin-5-one type magenta coupler, as is shown in the following general formula (III). Examples of the substituents for the phenyl group represented by D preferably include an alkyl group (e.g., a methyl group, an ethyl group, etc.), an alkoxy group (e.g., a methoxy group, an ethoxy group, etc.), an aryloxy group (e.g., a phenyloxy group, etc.), cyano group, a nitro group, a halogen atom (e.g., a fluorine atom, a chlorine atom, a bromine atom, etc.), and the like.

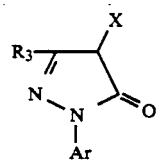

(III)

wherein Ar represents a substituent which is known as a substituent at the 1-position of a 2-pyrazolin-5-one coupler, including, for example, an alkyl group, a substituted alkyl group (for example, a haloalkyl group such as a fluoroalkyl group, a cyanoalkyl group, a benzylalkyl group, etc.), a heterocyclic group (for example, a 4-pyridyl group, a 2-thiazolyl group, etc.), a substituted heterocyclic group, an aryl group or a substituted aryl group. Examples of the substituents for the heterocyclic group and the aryl group include an alkyl group (for example, a methyl group, an ethyl group, etc.), an alkoxy group (for example, a methoxy group, an ethoxy group, etc.), an aryloxy group (for example, a phenoxy group, etc.), an alkoxycarbonyl group (for example, a methoxycarbonyl group, etc.), an acylamino group (for example, an acetylamino group, etc.), a carbamoyl group, an alkylcarbamoyl group (for example, a methylcarbamoyl group, an ethylcarbamoyl group, etc.), a dialkylcarbamoyl group (for example, a dimethylcarbamoyl group, etc.), an arylcarbamoyl group (for example, a phenylcarbamoyl group, etc.), an alkylsulfonyl group (for example, a methylsulfonyl group, etc.), an arylsulfonyl group (for example, a phenylsulfonyl group, etc.), an alkylsulfonamido group (for example, a methanesulfonamido group, etc.), an arylsulfonamido group (for example, a phenylsulfonamido group, etc.), a sulfamoyl group, an alkylsulfamoyl group (for example, an ethylsulfamoyl group, etc.), a dialkylsulfamoyl group (for example, a dimethylsulfamoyl group, etc.), an alkylthio group (for example, a methylthio group, etc.), an arylthio group (for example, a phenylthio group, etc.), a cyano group, a nitro group, a halogen atom (for example, a fluorine atom, a chlorine atom, a bromine atom, etc.), and the like. When two or more substituents are present they may be the same or different. Particularly preferred substituents include a halogen atom, an alkyl group, an alkoxy group, an alkoxycarbonyl group and a cyano group;

$R_3$ represents an unsubstituted or substituted anilino group, an unsubstituted or substituted acylamino group (for example, an alkylcarbonamido group, a phenylcarbonamido group, an alkoxycarbonamido group, a phenyloxycarbonamido group, etc.), an unsubstituted or substituted ureido group (for example, an alkylureido group, a phenylureido group, etc.) or an unsubstituted or substituted sulfonamido group, and examples of the substituents for these groups include a halogen atom (for example, a fluorine atom, a chlorine atom, a bromine atom, etc.), a straight chain or branched chain alkyl group (for example, a methyl group, a tert-butyl group, an octyl group, a tetradecyl group, etc.), an alkoxy group (for example, a methoxy group, an ethoxy group, a 2-ethylhexyloxy group, a tetradecyloxy group, etc.), an acylamino group (for example, an acetamido group, a benzamido group, a butanamido group, a octanamido group, a tetradecanamido group, an α-(2,4-ditertamylphenoxy)acetamido group, an α-(2,4-di-tert-amylphenoxy)butyramido group, an α-(3-pentadecylphenoxy)hexanamido group, an α-(4-hydroxy-3-tert-butylphenoxy)tetradecanamido group, a 2-oxopyrrolidin-1-yl group, a 2-oxo-5-tetradecylpyrrolidin-1-yl group, an N-methyltetradecanamido group, etc.), a sulfonamido group (for example, a methanesulfonamido group, a benzenesulfonamido group, an ethylsulfonamido group, a p-toluenesulfonamido group, an octanesulfonamido group, a p-dodecylbenzesulfonamido group, an N-methyltetradecanesulfonamido group, etc.), a sulfamoyl group (for example, a sulfamoyl group, an N-methylsulfamoyl group, an N-ethylsulfamoyl group, an N,N-dimethylsulfamoyl group, an N,N-dihexylsulfamoyl group, an N-hexadecylsulfamoyl group, an N-[3-(dodecyloxy)propyl]sulfamoyl group, an N-[4-(2,4-tert-amylphenoxy)butyl]sulfamoyl group, an N-methyl-N-tetradecylsulfamoyl group, etc.), a carbamoyl group (for example, an N-methylcarbamoyl group, an N-butylcarbamoyl group, an N-octadecylcarbamoyl group, an N-[4-(2,4-di-tert-amylphenoxy)-butyl]carbamoyl group, an N-methyl-N-tetradecylcarbamoyl group, etc.), a diacylamino group (for example, an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)-succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, a butoxysulfonyl group, an octyloxysulfonyl group, a tetradecyloxysulfonyl group, etc.), an aryloxysulfonyl group (for example, a phenoxysulfonyl group, a p-methylphenoxysulfonyl group, a 2,4-di-tertamylphenoxysulfonyl group, etc.), an alkanesulfonyl group (for example, a methanesulfonyl group, an ethanesulfonyl group, an octanesulfonyl group, a 2-ethylhexylsulfonyl group, a hexadecanesulfonyl group, etc.), an arylsulfonyl group (for example, a benzenesulfonyl group, a 4-nonylbenzenesulfonyl group, etc.), an alkylthio group (for example, a methylthio group, an ethylthio group, a hexylthio group, a benzylthio group, a tetradecylthio group, a 2-(2,4-di-tert-amylphenoxy)ethylthio group, etc.), an arylthio group (for example, phenylthio group, a p-tolylthio group, etc.), an alkyloxycarbonylamino group (for example, a methoxycarbonylamino group, an ethyloxycarbonylamino group, a benzyloxycarbonylamino group, a hexadecyloxycarbonylamino group, etc.), an alkylureido group (for example, an N-methylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, a carboxy group, a sulfo group, a hydroxy group or a trichloromethyl group, etc. In the above-described substituents, the alkyl moieties thereof preferably have from 1 to 36 carbon atoms, and the aryl moieties thereof preferably have from 6 to 38 carbon atoms; and X represents a halogen atom (for example, a chlorine atom, a bromine atom, etc.), a coupling releasing group connected through an oxygen atom (for example, an acetoxy group, a propanoyloxy group, a benzoyloxy group, an ethoxyoxaloyloxy group, a pyruvoyloxy group, a cinnamoyloxy group, a phenoxy group, a 4-cyanophenoxy group, a 4-methanesulfonamidophenoxy group, an α-naphthoxy group, a 4-cyanophenoxy group, a 4-methanesulfonamido-phenoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a coupling releasing group connected through a nitrogen atom (for example, those as described in Japanese patent application (OPI) No. 99437/84, more specifically, a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, 1-benzyl-5-ethoxy-3-hydantoinyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-tetrazol-1-yl group, a benzimidazolyl group, etc.) or a coupling releasing group connected through a sulfur atom (for example, a phenylthio group, a 2-carboxyphenylthio group, a 2-methoxy-5-octylphenylthio group, a 4-methanesulfonylphenylthio group, a 4-octanesulfonamidophenylthio group, a benzylthio group, a 2-cyanoethylthio group, a 5-phenyl-2,3,4,5-tetrazolylthio group, a 2-benzothiazolyl group, etc.). Of these coupling releasing groups, the coupling releasing groups connected through a nitrogen atom are preferred. A pyrazolyl group, an imidazolyl group and a triazolyl group are particularly preferred.

The coupler residue represented by Q is connected to $-(D)_l(E)_m(F)_n$ of the general formula (II) at any portion represented by Ar, $R_3$ or X.

In the general formula (II), E represents an unsubstituted or substituted alkylene group, preferably having from 1 to 10 carbon atoms, which may be a straight chain or a branched chain, an unsubstituted or substituted aralkylene group or an unsubstituted or substituted phenylene group. Examples of the alkylene group for E include a methylene group, a methylmethylene group, a dimethylmethylene group, a dimethylene group, a trimethylene group, a tetramethylene group, a pentamethylene group, a hexamethylene group, a decylmethylene group, etc. Examples of the aralkylene group for E include a benzylidene group, etc. Examples of the phenylene group for E include a p-phenylene group, an m-phenylene group, a methylphenylene group, etc.

Substituents for the alkylene group, the aralkylene group, or the phenylene group represented by E include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

Specific examples of the two-equivalent magenta monomer couplers represented by the general formula (I) which form the two-equivalent magenta polymer couplers used in the present invention are set forth below, but the present invention is not to be construed as being limited thereto.
(1)
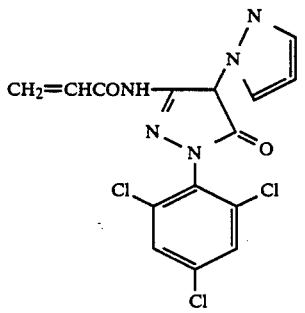
(2)
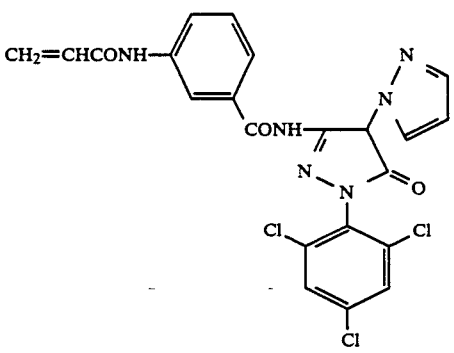
(3)
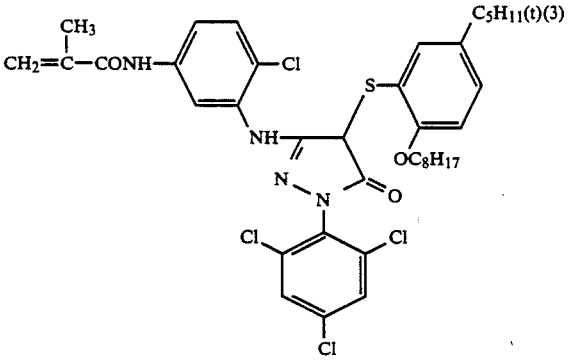
(4)
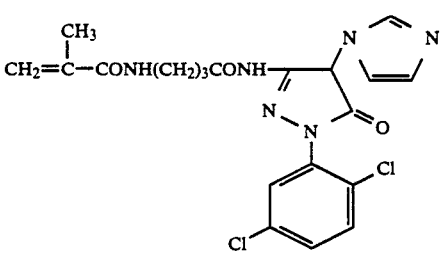
-continued
(5)
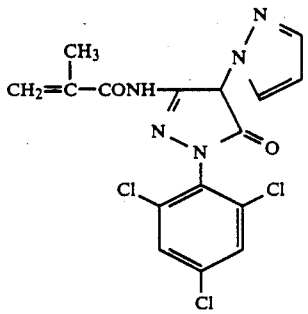
(6)
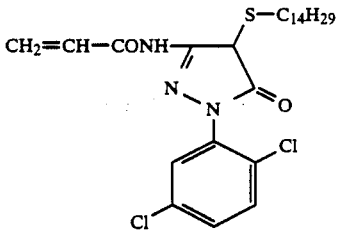
(7)
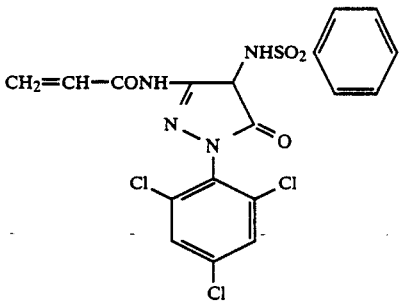
(8)
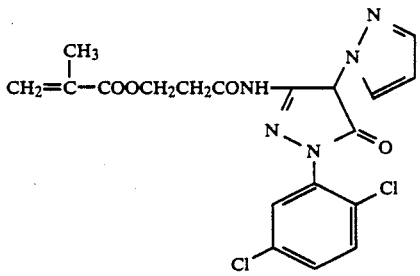
(9)
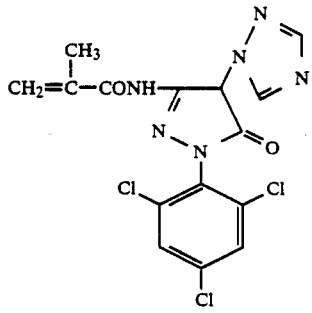

-continued
(10)
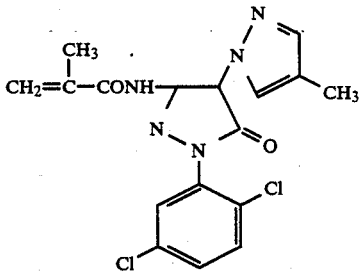
(11)
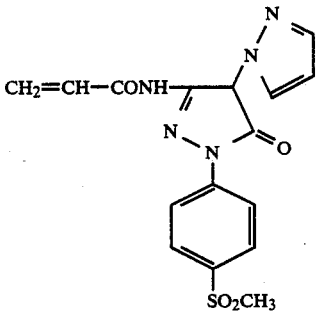
(12)
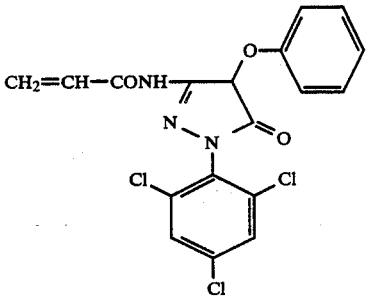
(13)
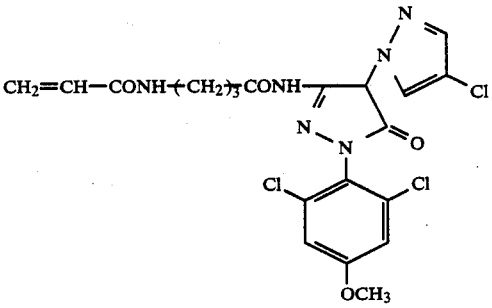
(14)
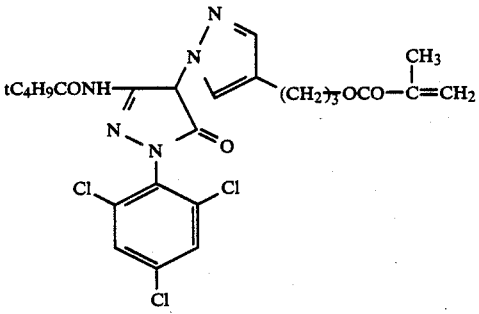
-continued
(15)
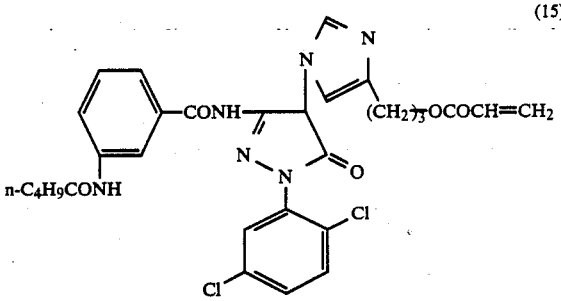
(16)
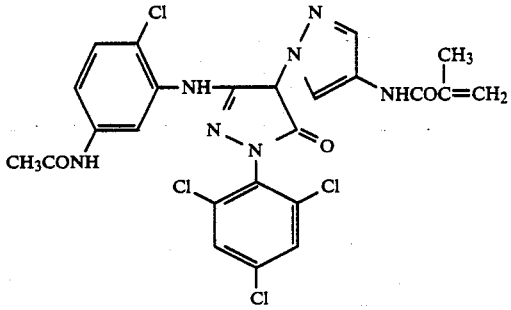
(17)
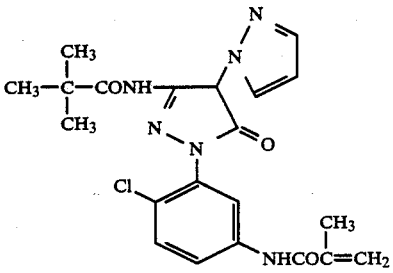
(18)
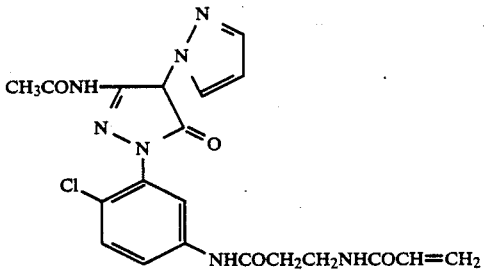
(19)
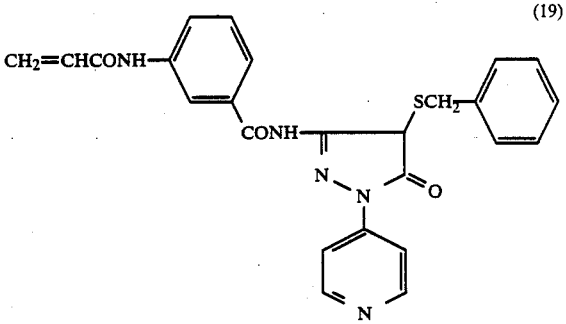

-continued
(20)
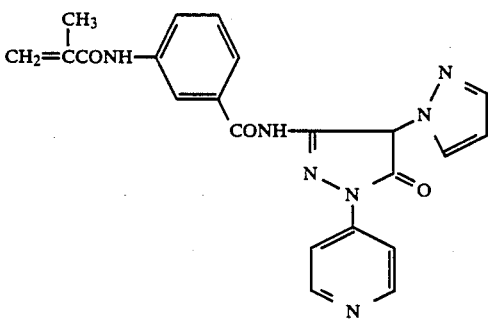
(21)
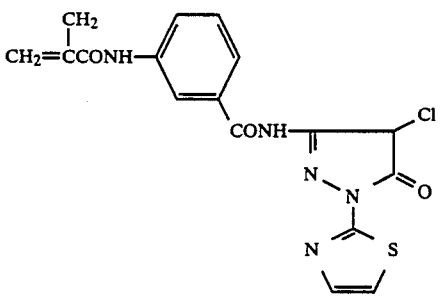
(22)
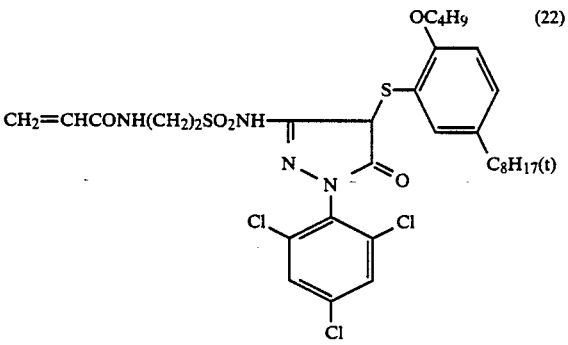
(23)
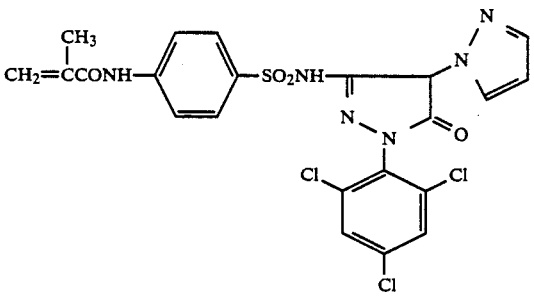
(24)
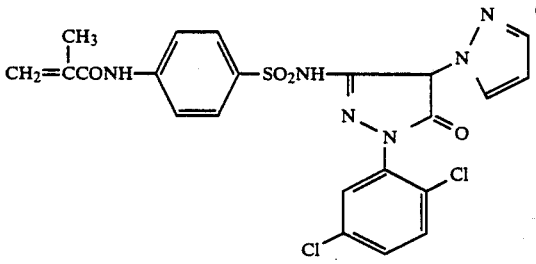
-continued
(25)
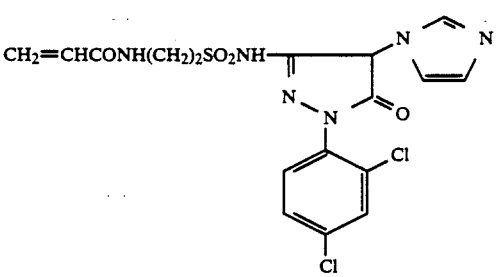
(26)
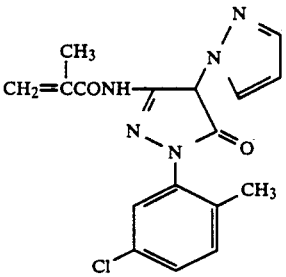
(27)
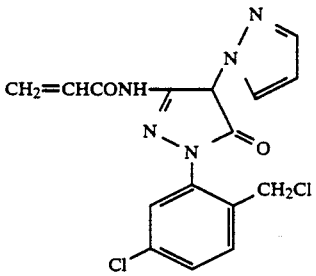
(28)
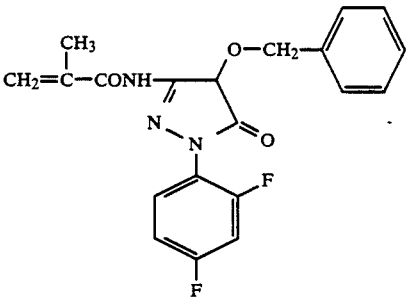
(29)
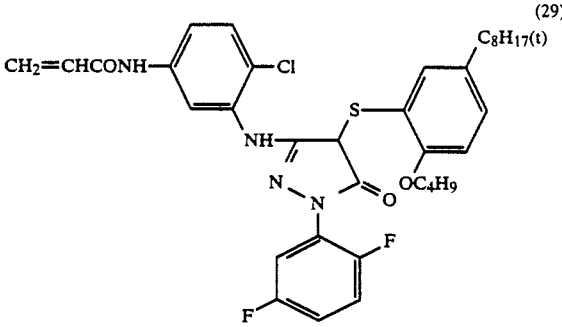

-continued
(30)
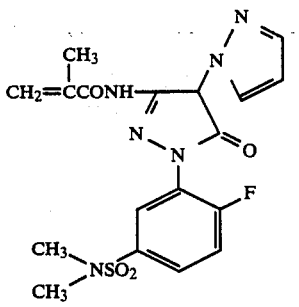
(31)
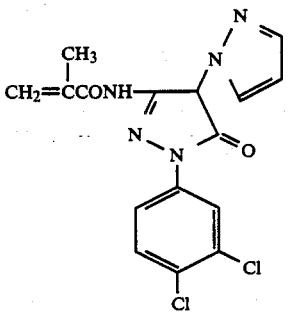
(32)
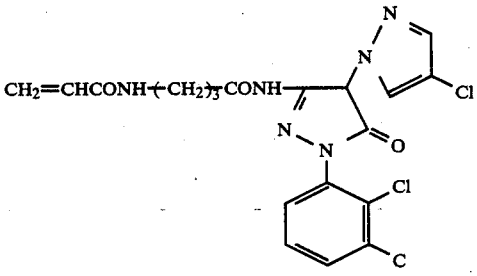
(33)
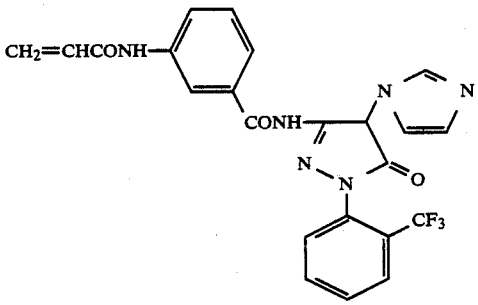
(34)
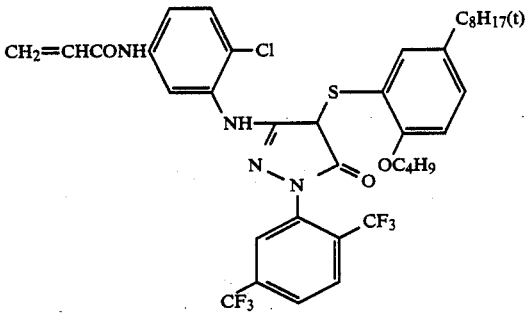
-continued
(35)
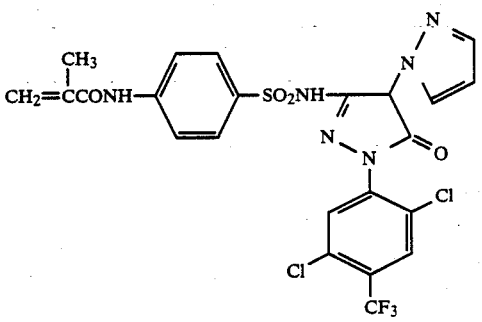
(36)
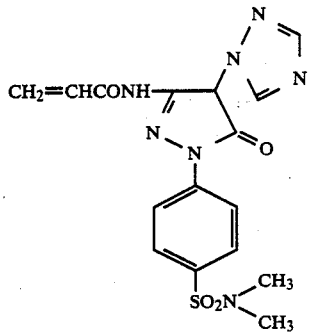
(37)
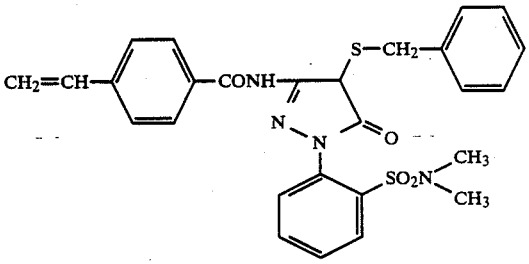
(38)
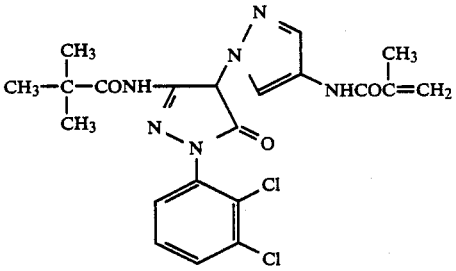
(39)
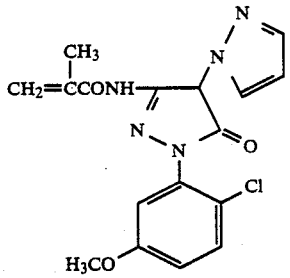

-continued (40)

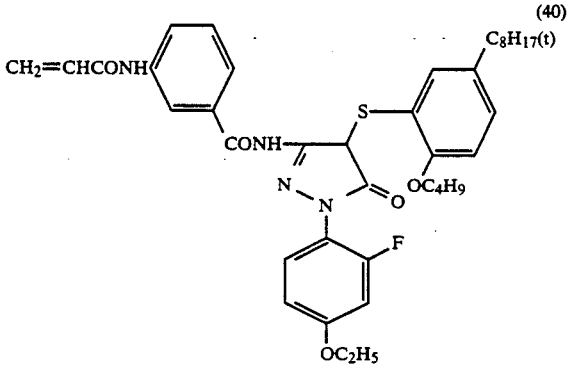

(41)

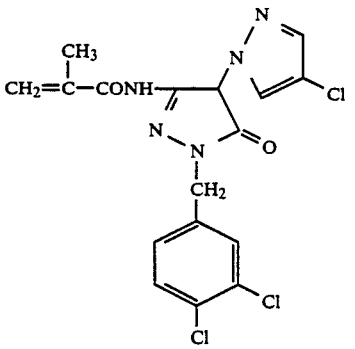

(42)

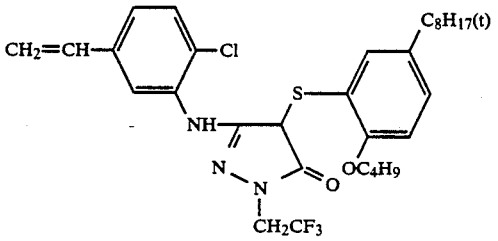

(43)

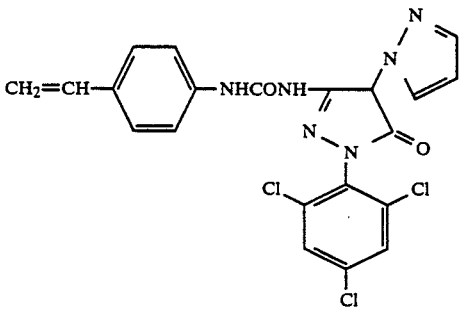

(44)

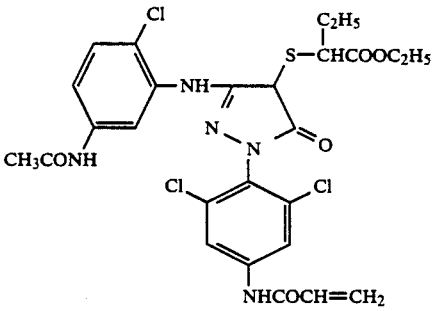

-continued (45)

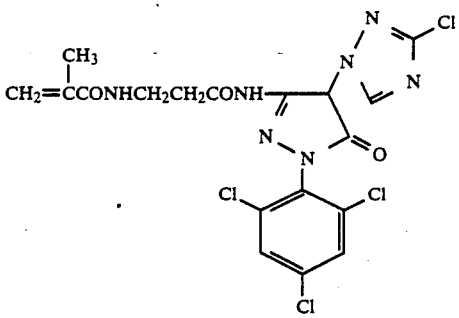

(46)

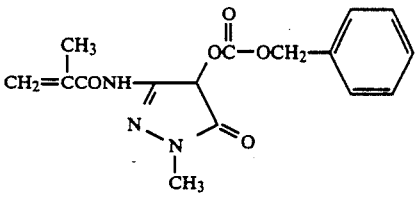

(47)

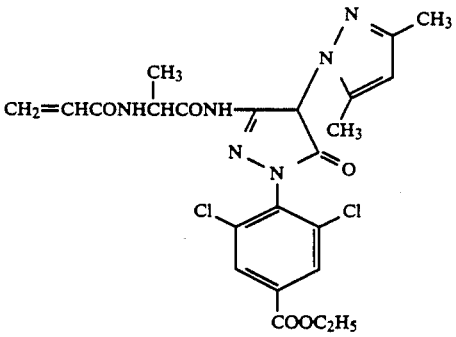

The two-equivalent magenta polymer coupler according to the present invention includes a polymer having a repeating unit derived from a monomer coupler represented by the general formula (II), and a copolymer having a repeating unit derived from a monomer coupler represented by the general formula (II) and at least one non-color forming unit containing at least one ethylene group which does not have an ability of oxidative coupling with an aromatic primary amine developing agent.

Examples of the non-color forming ethylenic monomer which does not couple with the oxidation product of an aromatic primary amine developing agent include an acrylic acid ester, a methacrylic acid ester, a crotonic acid ester, a vinyl ester, a maleic acid diester, a fumaric acid diester, an itaconic acid diester, an acrylamide, a methacrylamide, vinyl ether, a styrene, etc.

Specific examples of these non-color forming monomers are set forth below. Examples of acrylic acid esters include methyl acrylate, ethyl acrylate, n-propyl acrylate, isopropyl acrylate, n-butyl acrylate, isobutyl acrylate, tert-butyl acrylate, hexyl acrylate, 2-ethylhexyl acrylate, acetoxyethyl acrylate, phenyl acrylate, 2-methoxyethyl acrylate, 2-ethoxyethyl acrylate, 2-(2-methoxyethoxy)ethyl acrylate, etc. Examples of methacrylic acid esters include methyl methacrylate, ethyl methacrylate, n-propyl methacrylate, n-butyl methacrylate, tert-butyl methacrylate, cyclohexyl methacrylate, 2-hydroxyethyl methacrylate, 2-ethoxyethyl methacrylate, etc. Examples of crotonic acid esters include butyl crotonate, hexyl crotonate, etc. Examples of vinyl esters include vinyl acetate, vinyl propionate, vinyl butyrate, vinyl methoxyacetate, vinyl benzoate, etc. Examples of maleic acid diesters include diethyl maleate, dimethyl maleate, dibutyl maleate, etc. Examples of fumaric acid diesters include diethyl fumarate, dimethyl fumarate, dibutyl fumarate, etc. Examples of itaconic acid diesters include diethyl itaconate, dimethyl itaconate, dibutyl itaconate, etc. Examples of acrylamides include acrylamide, methylacrylamide, ethylacrylamide, propylacrylamide, n-butylacrylamide, tert-butylacryamide, cyclohexylacrylamide, 2-methoxyethylacrylamide, dimethylacrylamide, diethylacrylamide, phenyl acrylamide, etc. Examples of methacrylamides include methylmetharylamide, ethylmethacrylamide, n-butylmethacrylamide, tert-butylmethacrylamide, 2-methoxyethylmethacrylamide, dimethylmethacrylamide, diethylmethacrylamide, etc. Examples of vinyl ethers include methyl vinyl ether, butyl vinyl ether, hexyl vinyl ether, methoxyethyl vinyl ether, dimethylaminoethyl vinyl ether, etc. Examples of styrenes include styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, vinyl benzoic acid methyl ester, 2-methylstyrene, etc.

Other examples of the non-color forming ethylenic monomers include an allyl compound (for example, allyl acetate, etc.), a vinyl ketone (for example, methyl vinyl ketone, etc.), a vinyl heterocyclic compound (for example, vinyl pyridine, etc.), a glycidyl ester (for example, glycidyl acrylate, etc.), an unsaturated nitrile (for example, acrylonitrile, etc.), acrylic acid, methacrylic acid, itaconic acid, maleic acid, an itaconic acid monoalkyl ester (for example, monomethyl itaconate, etc.), a maleic acid monoalkyl ester (for example, monomethyl maleate, etc.), citraconic acid, vinyl sulfonic acid, an acryloyloxyalkylsulfonic acid (for example, acryloyloxymethylsulfonic acid, etc.), an acylamidoalkylsulfonic acid (for example, 2-acrylamido-2-methylethanesulfonic acid, etc.), and the like. The acid moiety included in these monomers may form a salt with an alkali metal ion (for example, a sodium ion, a potassium ion, etc.) or an ammonium ion.

Of these non-color forming monomers, an acrylic acid ester, a methacrylic acid ester, a styrene, a maleic acid ester, an acrylamide and a methacrylamide are preferably employed as a comonomer in view of the hydrophilicity of the monomer, the oleophilicity of the monomer, the copolymerizability of the monomer, the color forming property of the polymer coupler formed, the oil pKa' of the polymer coupled formed, and the hue of the dye formed, etc.

Two or more of these monomers can be used together. For example, a combination of n-butyl acrylate and styrene, n-butyl acrylate and butylstyrene, and tert-butylmethacrylamide and n-butyl acrylate, etc. can be used.

It is desirable if the ratio of the color forming portion corresponding to the general formula (II) in the polymer coupler according to the present invention is usually from 5 to 80% by weight. Particularly, a ratio from 30 to 70% by weight is preferred in view of color reproducibility, color forming property and stability. In this case, an equivalent molecular weight, that is, a gram number of the polymer containing 1 mol of a monomer coupler, is from about 250 to 4,000, but it is not limited thereto.

The polymer coupler latex according to the present invention can be incorporated into a silver halide emulsion layer or an adjacent layer thereto.

The polymer coupler latex according to the present invention is employed in a range from 0.005 mol to 0.5 mol, preferably from 0.01 mol to 0.1 mol, of coupler monomer per mol of silver when it is incorporated into the silver halide emulsion layer.

Further, a coating amount of the polymer coupler latex according to the present invention in the case of using it in a light-insensitive layer is in a range from 0.01 $g/m^2$ to 1.0 $g/m^2$, preferably from 0.1 $g/m^2$ to 0.5 $g/m^2$.

The magenta polymer coupler latex used in the present invention can be prepared by dissolving an oleophilic polymer coupler obtained by polymerization of a monomer coupler in an organic solvent and then dispersing the solution in a latex form in an aqueous gelatin solution, or can be directly prepared by an emulsion polymerization method, as described above. With respect to the method in which an oleophilic polymer coupler is dispersed in a latex form in an aqueous gelatin solution, the method as described in U.S. Pat. No. 3,451,820 can be employed, and with respect to the emulsion polymerization, the methods as described in U.S. Pat. Nos. 4,080,211 and 3,370,952 can be employed.

Synthesis of the magenta polymer coupler according to the present invention can be conducted using a polymerization initiator and a polymerization solvent such as those as described in Japanese patent application (OPI) Nos. 5543/81, 94752/82, 176038/82, 204038/82, 28745/83, 10738/83, 42044/83 and 145944/83, etc.

In order to determine the temperature for polymerization it is necessary to take the molecular weight of the polymer to be formed and the kind of initiator employed, etc. into consideration. It is possible to utilize a temperature of from 0° C. or lower to 100° C. or higher, but usually the polymerization is carried out at a temperature range of from 30° to 100° C.

Typical synthesis examples of the polymer couplers according to the present invention are set forth below.

SYNTHESIS METHOD (I)

SYNTHESIS EXAMPLE 1

Synthesis of Copolymer of 1-(2,4,6-trichlorophenyl)-3-acryloylamino-4-pyrazolyl-2-pyrazolin-5-one [Monomer Coupler [1] and 4-butylstyrene [Oleophilic Polymer Coupler (A)]

A mixture of 50 g of Monomer Coupler (1), 50 g of 4-butylstyrene and 400 ml of dioxane was stirred at 85° C. while introducing nitrogen gas. To the mixture was added 20 ml of a dioxane solution containing 4 g of dimethyl azobisisobutyrate dissolved, and the mixture was reacted for 6 hours. The resulting solution was added dropwise to 2 liters of water, the solid thus deposited was collected by filtration, washed with water and dried to obtain 99.2 g of Polymer Coupler (A).

It was found that Polymer Coupler (A) contained 48.1% of Monomer Coupler (1) in the copolymer obtained as the result of nitrogen and chlorine analysis. The oil pKa' was 8.5.

SYNTHESIS EXAMPLE 2

Synthesis of Copolymer of 1-(2,4,6-trichlorophenyl)-3-methacryloylamino-4-pyrazolyl-2-pyrazolin-5-one [Monomer Coupler (5)] and 4-butoxystyrene [Oleophilic Polymer Coupler (B)]

A mixture of 50 g of Monomer Coupler (5), 50 g of 4-butoxystyrene and 300 ml of ethyl acetate was stirred at 75° C. while introducing nitrogen gas. To the mixture was added 20 ml of an ethyl acetate solution containing 4 g of dimethyl azobisisobutyrate dissolved, and the mixture was reacted for 6 hours. After cooling the reaction mixture, the ethyl acetate was distilled off under a reduced pressure and the residue was collected and dried to obtain 98.1 g of Polymer Coupler (B).

It was found that Polymer Coupler (B) contained 48.7% of Monomer Coupler (5) in the copolymer obtained as the result of nitrogen and chlorine analysis. The oil pKa' was 9.0.

SYNTHESIS EXAMPLE 3

Synthesis of Copolymer of 1-(2,4,6-trichlorophenyl)-3-pivaloylamino-4-(4-methacryloyloxypropylpyrazolyl)-2-pyrazolin-5-one [Monomer Coupler (14)], styrene and n-butyl acrylate [Oleophilic Polymer Coupler (C)]

A mixture of 50 g of Monomer Coupler (14), 30 g of styrene, 20 g of n-butyl acrylate and 300 ml of n-propanol was stirred at 85° C. while introducing nitrogen gas. The the mixture was added 20 ml of a n-propanol solution containing 3 g of dimethyl azobisisobutyrate dissolved, and the mixture was reacted for 6 hours. The resulting solution was added dropwise to 2 liters of water, the solid thus deposited was collected by filtration, washed with water and dried to obtain 97.3 g Polymer Coupler (C).

It was found that Polymer Coupler (C) contained 49.8% of Monomer Coupler (14) in the copolymer obtained as the result of nitrogen and chlorine analysis. The oil pKa' was 8.7.

SYNTHESIS EXAMPLES 4 TO 18

Oleophilic Polymer Couplers (D) to (R) were synthesized in the same manner as described in Synthesis Examples 1 to 3 using the monomers shown in the following table.

| | Oleophilic Polymer Coupler obtained by Synthesis Method (1) | | | | | |
|---|---|---|---|---|---|---|
| Synthesis Examples | Oleophilic Polymer Coupler | Monomer Coupler | Amount (g) | Non-Color*[1] Forming Monomer | Amount (g) | Monomer Coupler Unit in Polymer (wt %) |
| 4 | D | (1) | 30 | 2-EHA | 70 | 31.2 |
| 5 | E | (2) | 40 | St | 40 | 40.6 |
| | | | | n-BA | 20 | |
| 6 | F | (3) | 50 | 4-Butylstyrene | 50 | 49.8 |
| 7 | G | (6) | 35 | n-BA | 65 | 34.6 |
| 8 | H | (8) | 45 | St | 40 | 44.3 |
| | | | | EA | 15 | |
| 9 | I | (9) | 50 | St | 40 | 50.1 |
| | | | | n-BA | 10 | |
| 10 | J | (12) | 35 | t-BMA | 65 | 36.2 |
| 11 | K | (17) | 50 | 4-Methylstyrene | 30 | 47.8 |
| | | | | 2-EHA | 20 | |
| 12 | L | (19) | 40 | 4-Butylstyrene | 60 | 41.5 |
| 13 | M | (23) | 30 | 2,4,6-Trimethylstyrene | 30 | 32.4 |
| | | | | n-BA | 40 | |
| 14 | N | (26) | 50 | tert-Butylmethacrylamide | 10 | 49.7 |
| | | | | n-BA | 40 | |
| 15 | O | (31) | 60 | 4-Butylstyrene | 40 | 60.1 |
| 16 | P | (37) | 35 | n-BA | 65 | 36.3 |
| 17 | Q | (39) | 45 | t-BMA | 55 | 45.7 |
| 18 | R | (43) | 40 | 2-EHA | 60 | 40.2 |

*[1]EA: Ethyl Acrylate, n-BA: n-Butyl Acrylate, 2-EHA: 2-Ethylhexyl Acrylate, t-BMA: tert-Butyl Methacrylate, St: Styrene

SYNTHESIS METHOD (II)

SYNTHESIS EXAMPLE 19

Synthesis of Copolymer latex of 1-(2,4,6-trichlorophenyl)-3-methacryloylamino-4-pyrazolyl-2-pyrazolin-5-one [Monomer Coupler (5)], styrene and tert-butyl methacrylate [Polymer Latex Coupler (A')]

1 liter of an aqueous solution containing 3 g of oleyl methyl tauride dissolved was heated to 85° C. while introducing nitrogen gas in a 2 liter flask. To the aqueous solution was added 30 ml of a 2% aqueous solution of potassium persulfate. 20 g of Monomer Coupler (5), 10 g of styrene and 10 g of tert-butyl methacrylate were dissolved by heating in 300 ml of ethanol and the resulting solution was added dropwise to the above described aqueous solution over a period of 7 hours. After being reacted for 2 hours, ethanol and the monomers not reacted were distilled off as an azeotropic mixture with water. The latex thus formed was cooled, the pH was adjusted to 6.0 with a 1N aqueous solution of sodium hydroxide and filtered.

The concentration of the polymer in the latex formed was 6.6% and it was found that the copolymer contained 51.3% of Monomer Coupler (5) as the result of chlorine analysis. The oil pKa' measured after the latex being freeze-dried was 8.8.

SYNTHESIS EXAMPLES 20 TO 30

Polymer Latex Couplers (B') to (L') were synthesized in the same manner as described in Synthesis Example 19 using the monomers shown in the following table.

Polymer Latex Coupler obtained by Synthesis Method (II)

| Synthesis Example | Polymer Latex Coupler | Monomer Coupler | Amount (g) | Non-Color*2 Forming Monomer | Amount (g) | Monomer Coupler Unit in Polymer (wt %) |
|---|---|---|---|---|---|---|
| 20 | B' | (1) | 10 | n-BA | 20 | 35.6 |
| 21 | C' | (2) | 15 | St | 10 | 38.1 |
| | | | | 2-EHA | 15 | |
| 22 | D' | (3) | 20 | 4-Butylstyrene | 20 | 52.3 |
| 23 | E' | (5) | 20 | St | 10 | 41.9 |
| | | | | n-BA | 20 | |
| 24 | F' | (6) | 20 | 4-Butoxystyrene | 20 | 45.7 |
| | | | | MAA | 5 | |
| 25 | G' | (14) | 20 | St | 20 | 47.2 |
| | | | | EA | 5 | |
| 26 | H' | (17) | 20 | 4-Methylstyrene | 30 | 40.5 |
| 27 | I' | (24) | 20 | St | 20 | 50.3 |
| 28 | J' | (31) | 20 | n-BA | 20 | 51.6 |
| 29 | K' | (37) | 15 | n-BA | 35 | 30.3 |
| 30 | L' | (43) | 15 | 2-EHA | 20 | 42.9 |

*2EA: Ethyl Acrylate, n-BA: n-Butyl Acrylate, 2-EHA: 2-Ethylhexyl Acrylate, St: Styrene, MAA: Methacrylic Acid The hydrolizable type DIR coupler which can be used in the present invention is a coupler having at its coupling active position a group which acts as a compound having a development inhibiting function (i.e., a development inhibitor or precursor thereof) when released from the coupling active position of the coupler upon a color development reaction and which is capable of being decomposed to a compound having substantially no effect on photographic properties after being discharged into a color developing solution. The development inhibitor or precursor thereof should have a certain decomposition rate coefficient. More specifically, a half-value period of the development inhibitor or precursor thereof at pH 10.0 is 4 hours or less, preferably 2 hours or less, and more preferably 1 hour or less.

Measurement of a half-value of period of the development inhibitor or precursor thereof in the present invention can be easily carried out in the following manner. This is, a development inhibitor to be measured is added to a developing solution having the composition shown below in an amount of $1\times10^{-4}$ mol/liter, the solution is maintained at 38° C. and a concentration of the remaining development inhibitor is determined by liquid chromatography whereby a half-value period of the development inhibitor is obtained.

| Composition of Developing Solution: | |
|---|---|
| Diethylenetriaminepentaacetic Acid | 0.8 g |
| 1-Hydroxyethylidene-1,1-diphosphonic Acid | 3.3 g |
| Sodium sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.0 |

The half-value period is widely varied depending on the pH of a developing solution employed. For example, a half-value period becomes shorter as the pH increases. Therefore, it is possible to control the remaining amount of the development inhibitor by adjusting the pH of a developing solution at the time of development processing.

Equilibrium concentration (x) of the development inhibitor under the running condition in the case of using the DIR coupler having a hydrolizable type releasing group as described above may be represented by the following differential equation.

$$dx=[a-(v+kV)x]\,dt$$

wherein k represents a decomposition rate coefficient; V represents the capacity of a developing tank; a represents the amount of discharged development inhibitor; and v represents the amount of replenishment.

In the above equation, when dx/dt is O, x is a/(v+kV). From the result, it is understood that the equilibrium concentration (x) of a development inhibitor depends on the amount of discharged development inhibitor (a) and the composition rate coefficient (k).

Any hydrolizable type DIR coupler which satisfies the condition of half-value period described above can be employed in the present invention. More specifically, hydrolizable type DIR couplers represented by the following general formula (IV) can be used.

$$A\text{-}[(L_1)_a\text{—}Z\text{—}(L_2\text{—}Y)_b]_p \qquad \text{(IV)}$$

wherein A represents a coupler component; Z represents a fundamental portion of a compound having a development inhibiting function which is connected directly (when a is 0) or through a linking group $L_1$ (when a is 1) with the coupling position of the coupler; Y is connected with Z through a linking group $L_2$ and represents a substituent capable of generating the development inhibiting function of Z; $L_1$ represents a linking group; $L_2$ represents a linking group including a chemical bond which is cut in a developing solution; a represents 0 or 1; b represents 1 or 2, when b represents 2, two —$L_2$—Y's may be the same or different; and p represents 1 or 2.

The compound represented by the general formula (IV) may release $\ominus$Z—($L_2$—Y)$_b$ or $\ominus L_1$—Z—($L_2$—Y)$_b$ after the coupling reaction with an oxidation product of a color developing agent. The latter changes immediately into $\ominus$Z—($L_2$—Y)$_b$ by releasing $L_1$. The $\ominus$Z—($L_2$—Y)$_b$ diffuses in the light-sensitive layer while exhibiting the development inhibiting function and a part thereof discharges into the color developing solution.

The $^{\ominus}Z$—$(L_2—Y)_b$ discharged into the color developing solution rapidly decomposes at the chemical bond included in $L_2$, that is, the connection between Z and Y is cut whereby a compound which has a small development inhibiting function and which has a water-soluble group in Z remains in the color developing solution, and thus the development inhibiting function substantially disappears.

Consequently, it is possible not only to repeatedly utilize a processing solution since compounds having the development inhibiting function are not accumulated in the processing solution but also to incorporate a sufficient amount of DIR couplers into a photographic light-sensitive material.

Hydralizable type DIR couplers represented by the general formula (IV) are described in more detail below.

Preferred examples of yellow color image forming coupler residues represented by A include those of pivaloyl acetanilide type, benzoyl acetanilide type, malonic diester type, malondiamide type, dibenzoylmethane type, benzothiazolyl acetamide type, malonic ester monoamide type, benzothiazolyl acetate type, benzoxazolyl acetamide type, benzoxazolyl acetate type, benzimidazolyl acetamide type and benzimidazolyl acetate type; the coupler residues derived from hetero ring-substituted acetamides or hetero ring-substituted acetates involved in U.S. Pat. No. 3,841,880; the coupler residues derived from the acyl acetamides as described in U.S. Pat. No. 3,770,446, British Pat. No. 1,459,171, West German patent application (OLS) No. 2,503,099, Japanese patent application (OPI) No. 139738/75 and *Research Disclosure,* No. 15737; and the hetero ring type coupler residues as described in U.S. Pat. No. 4,046,574, etc.

Preferred examples of magenta color image forming coupler residues represented by A include those of 5-oxo-2-pyrazoline type, pyrazolo[1,5-a]benzimidazole type and cyanoacetophenone type; and coupler residues having a pyrazolotriazole nucleus, etc.

Preferred examples of cyan color image forming coupler residues represented by A include those having a phenol nucleus or an α-naphthol nucleus.

Further, DIR couplers which release a development inhibitor upon coupling with an oxidation product of a developing agent and substantially does not form a dye are employed. Suitable examples of such a type of coupler residues represented by A include the coupler residues as described in U.S. Pat. Nos. 4,052,213, 4,088,491, 3,632,345, 3,958,993 and 3,961,959, etc.

The fundamental portion of a development inhibitor represented by Z includes a divalent nitrogen-containing heterocyclic group and a nitrogen-containing heterocyclic thio group. Suitable examples of heterocyclic thio groups include a tetrazolylthio group, a benzothiazolylthio group, a benzimidazolylthio group, a triazolylthio group, and an imidazolylthio group, etc. Suitable examples of Z are set forth together with the positions substituted with the A—$(L_1)_a$— group and the —$(L_2—Y)_b$ group below.

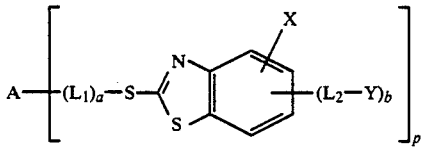

-continued

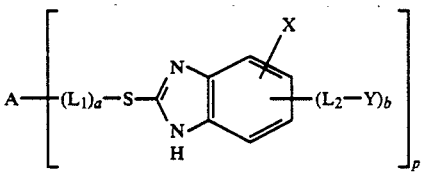

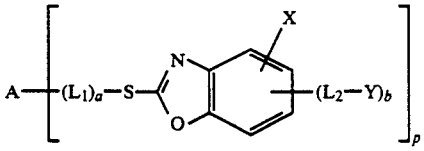

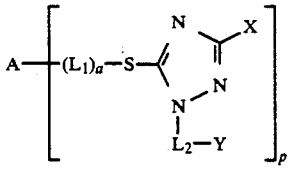

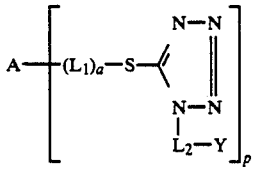

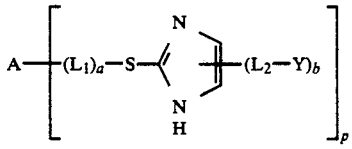

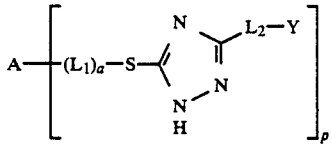

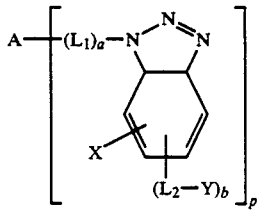

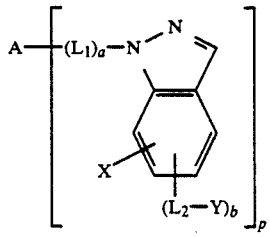

-continued

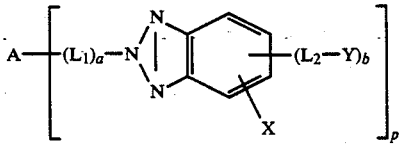

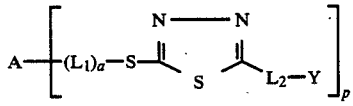

In the above described formulae, the substituent represented by X, which is included in the portion of Z in the general formula (IV), represents a hydrogen atom, a halogen atom, an alkyl group, an alkenyl group, an alkanamido group, an alkenamido group, an alkoxy group, a sulfonamido group or an aryl group.

Suitable examples of the sulfonamido group represented by X include a straight chain, branched chain or cyclic alkylsulfonamido group having 1 to 10 carbon atoms, preferably 1 to 5 carbon atoms and an arylsulfonamido groups having 6 to 10 carbon atoms, which may be substituted by a substituent selected from the substituents as defined for the above described alkyl group or alkenyl group, etc.

Suitable examples of the group represented by Y in the general formula (IV) include an alkyl group, an alkenyl group, an aryl group, an aralkyl group and a heterocyclic group, etc. Suitable examples of the aralkyl group include one having 7 to 30 carbon atoms, preferably 7 to 15 carbon atoms, which may be substituted by a substituent selected from the substituents as defined for the above described alkyl group or alkenyl group, etc.

Suitable examples of the group represented by Y in the general formula (IV) include an alkyl group, a cycloalkyl group, an alkenyl group, a cycloalkenyl group, an aryl group, an aralkyl group and a heterocyclic group, etc.

Suitable examples of the linking group represented by $L_1$ in the general formula (IV) are set forth together with A and $Z—(L_2—Y)_b$ below.

$$A\text{[}—OCH_2—Z—(L_2—Y)_b]_p$$

[the linking group as described in U.S. Pat. No. 4,146,396]

$$A\text{[}SCH_2—Z—(L_2—Y)_b]_p$$

$$A\text{[}O\overset{O}{\overset{\|}{C}}—Z—(L_2—Y)_b]_p$$

[the linking group as described in West German patent application (OLS) No. 2,626,315]

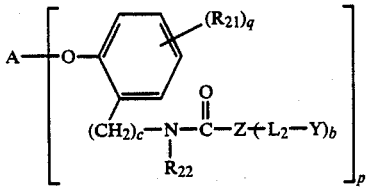

[the linking group as described in West German patent application (OLS) No. 2,855,697; c represents an integer from 0 to 2]

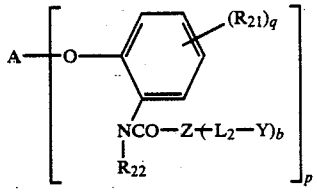

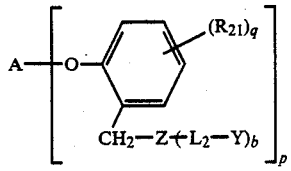

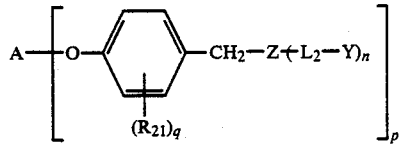

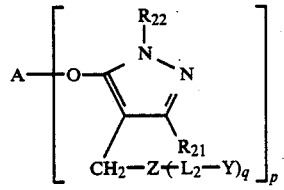

In the above described formulae, $R_{21}$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a cycloalkyl group, an alkanesulfonyl group, an arylsulfonyl group or an acyl group; $R_{22}$ represents a hydrogen atom, an alkyl group, an alkenyl group, an aralkyl group, a cycloalkyl group or an aryl group; p and q each represents 1 to 2, and when q represents 2, two $R_{21}$ may be bonded to each other to form a condensed ring.

With these DIR couplers (i.e., cases wherein a represents 1 in the general formula (IV), a releasing group released upon the reaction with an oxidation product of a developing agent decomposes immediately and releases a development inhibitor $[H—Z—(L_2—Y)_b]$. Therefore these couplers have the same effect of the present invention as that the DIR couplers which do not contain the group represented by $L_1$ (i.e., cases wherein a represents 0 in the general formula (IV)) have.

The linking group represented by $L_2$ in the general formula (IV) includes a chemical bond which is cleaved in a developing solution. Suitable examples of such chemical bonds include those described in the table below. These chemical bonds are cleaved with a nucleophilic reagent such as a hydroxy ion or a hydroxylamine, etc. which is a component of the color developing solution thereby the effect of the present invention is attained.

TABLE

| Chemical Bond Included in $L_2$ | Cleavage Reaction of Chemical Bond (Reaction with $^{\ominus}OH$) |
|---|---|
| $-COO-$ | $-COOH- + HO-$ |
| $-\overset{H}{N}COO-$ | $-NH_2 + HO-$ |
| $-SO_2O-$ | $-SO_3H + HO-$ |
| $-OCH_2CH_2SO_2-$ | $-OH + CH_2{=}CHSO_2-$ |
| $-O\underset{\underset{O}{\|}}{C}O-$ | $-OH + HO-$ |
| $-NH\underset{\underset{O}{\|}}{C}\underset{\underset{O}{\|}}{C}O-$ | $-NH_2 + HO-$ |

The divalent linking group shown in the table above is connected directly or through an alkylene group and/or a phenylene group with Z and connected directly with Y. When the divalent linking group is connected through an alkylene group and/or a phenylene group, the alkylene group and/or phenylene group may contain an ether bond, an amido bond, a carbonyl group, a thioether bond, a sulfon group, a sulfamido bond or a ureido bond.

Preferred examples of the linking group represented by $L_2$ are set forth together with the positions substituted with Z and Y below.

$-Z-(CH_2)_d\overset{O}{\|}COO-Y$ $-Z-(CH_2)_d\overset{O}{\|}OC-Y$

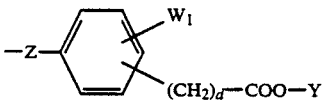

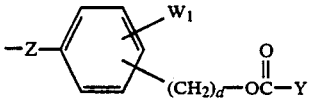

$-Z-(CH_2)_d-NHCOO-Y$ $-Z-(CH_2)_d-\overset{O}{\|}OCNH-Y$ $-Z-NH\overset{O}{\|}C-(CH_2)_d\overset{O}{\|}CO-Y$

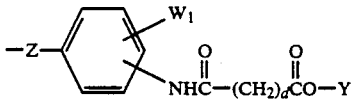

$-Z\leftarrow CH_2\rightarrow_e COOCH_2CH_2SO_2-Y$

-continued

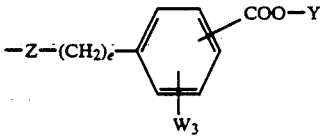

$-Z-NCOO-Y$ ($W_2$)

$-Z-N-COCO-Y$ ($W_2$)

In the above described formulae, d represents an integer from 0 to 10, preferably from 0 to 5; $W_1$ represents a hydrogen atom, a halogen atom, an alkyl group having from 1 to 10, preferably from 1 to 5 carbon atoms, an alkanamido group having from 1 to 10, preferably from 1 to 5 carbon atoms, an alkoxy group having from 1 to 10, preferably from 1 to 5 carbon atoms, an alkoxycarbonyl group having from 1 to 10, preferably from 1 to 5 carbon atoms, an aryloxycarbonyl group, an alkanesulfonamido group having from 1 to 10, preferably 1 to 5 carbon atoms, an aryl group, a carbamoyl group, an N-alkylcarbamoyl group having from 1 to 10, preferably from 1 to 5 carbon atoms, a nitro group, a cyano group, an arylsulfonamido group, a sulfamoyl group or an imido group; $W_2$ represents a hydrogen atom, an alkyl group having from 1 to 6 carbon atoms, an aryl group or an alkenyl group; $W_3$ represents a hydrogen atom, a halogen atom, a nitro group, an alkoxy group having from 1 to 6 carbon atoms or an alkyl group; and e represents an integer from 0 to 6.

The alkyl group or the alkenyl group represented by X or Y specifically represents a straight chain, branched chain or cyclic alkyl group or alkenyl group having 1 to 10, preferably 1 to 5 carbon atoms, and preferably has a substituent. Examples of the substituents include a halogen atom, a nitro group, an alkoxy group having from 1 to 4 carbon atoms, an aryloxy group having from 6 to 10 carbon atoms, an alkanesulfonyl group having from 1 to 4 carbon atoms, an arylsulfonyl group having from 6 to 10 carbon atoms, an alkanamido group having from 1 to 5 carbon atoms, an anilino group, a benzamido group, a carbamoyl group, a carbamoyl group substituted with an alkyl group having from 1 to 6 carbon atoms, a carbamoyl group substituted with an aryl group having from 6 to 10 carbon atoms, an alkylsulfonamido group having from 1 to 4 carbon atoms, an arylsulfonamido group having from 6 to 10 carbon atoms, an alkylthio group having from 1 to 4 carbon atoms, an arylthio group having from 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having from 1 to 4 carbon atoms, an alkanoyl group having from 1 to 4 carbon atoms, a benzoyl group, an alkanoyloxy group having from 1 to 4 carbon atoms, a benzoyloxy group, a perfluoroalkyl group having from 1 to 4 carbon atoms, a cyano group, a tetrazolyl group, a hydroxy group, a carboxy group, a mercapto group, a sulfo group, an amino group, an alkylsulfamoyl group having from 1 to 4 carbon atoms, an arylsulfamoyl group having from 6 to 10 carbon atoms, a morpholino group, an aryl group having from 6 to 10 carbon atoms, a pyrrolidinyl group, a ureido group, a urethane group, a carbonyl group substituted with an alkoxy group having from 1 to 6 carbon atoms, a carbonyl group substituted with an aryloxy group having from 6 to 10 carbon atoms, an imidazolidinyl group or an alkylidenamino group having from 1 to 6 carbon atoms, etc.

The alkanamido group or the alkenamido group represented by X specifically represents a straight chain, branched chain or cyclic alkanamido group or alkenamido group having from 1 to 10, preferably from 1 to 5 carbon atoms which may be substituted. Examples of the substituents are selected from the substituents as defined for the above described alkyl group or alkenyl group, etc.

The alkoxy group represented by X specifically represents a straight chain, branched chain or cyclic alkoxy group having from 1 to 10, preferably from 1 to 5 carbon atoms which may be substituted. Examples of the substituents are selected from the substituents as defined for the above described alkyl group or alkenyl group, etc.

The aryl group represented by X and Y specifically represents a phenyl group or a naphthyl group which may be substituted. Examples of the substituents are selected from the substituents as defined for the above described alkyl group or alkenyl group and an alkyl group having from 1 to 4 carbon atoms, etc.

The heterocyclic group represented by Y include a diazolyl group (for example, a 2-imidazolyl group, a 4-pyrazolyl group, etc.), a triazolyl group (for example, a 1,2,4-triazol-3-yl group, etc.), a thiazolyl group (for example, a 2-benzothiazolyl group, etc.), an oxazolyl group (for example, a 1,3-oxazol-2-yl group, etc.), a pyrrolyl group, a pyridyl group, a diazinyl group (for example, a 1,4-diazin-2-yl group, etc.), a triazinyl group (for example, a 1,2,4-triazin-5-yl group, etc.), a furyl group, a diazolinyl group (for example, an imidazolin-2-yl group, etc.), a pyrrolinyl group, or a thienyl group, etc.

Of the couplers represented by the general formula (IV), preferred couplers are those represented by the general formula (V), (VI), (VII), (VIII), (IX), (X) or (XI) shown below. These couplers are preferred since the development inhibiting function of development inhibitor released therefrom is strong.

(V)

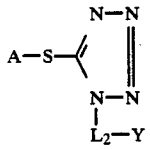

(VI)

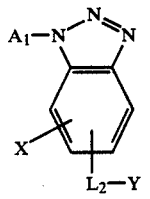

-continued (VII)

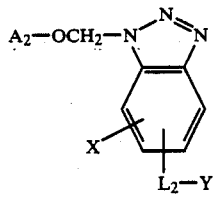

(VIII)

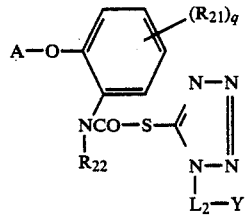

(IX)

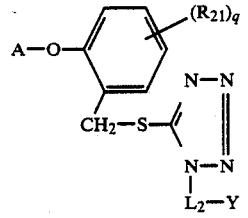

(X)

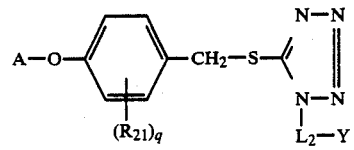

(XI)

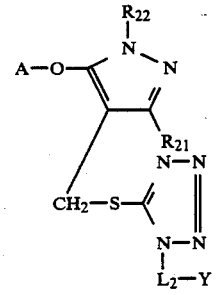

In the above described general formulae (V) to to (XI), q, A, $L_2$, X, $R_{21}$, $R_{22}$ and Y each has the same meaning as defined in the general formula (IV).

In the above described general formula (VI), $A_1$ represents the coupler residue as defined for A in the general formula (IV) except the cyan color image forming coupler residues.

In the above described general formula (VII), $A_2$ represents the cyan color image forming coupler residue of the coupler residues as defined for A in the general formula (IV).

Further, the effects of the present invention are particularly exhibited when the couplers represented by the general formula (XII), (XIII), (XIV), (XV), (XVI), (XVII), (XVIII), (XIV), (XX), (XXI) or (XXII) described below are employed. These couplers are preferred because of their high coupling rates.

(XII)
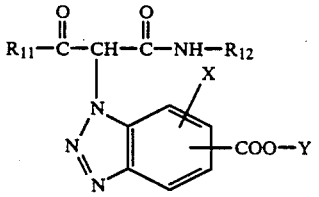
(XIII)
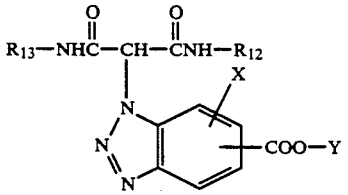
(XIV)
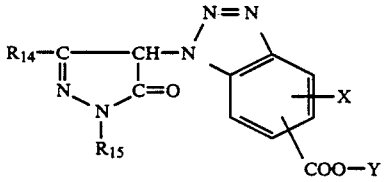
(XV)
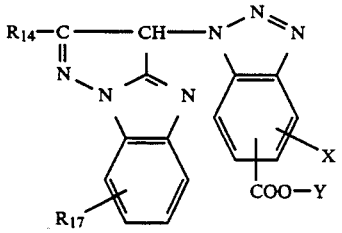
(XVI)
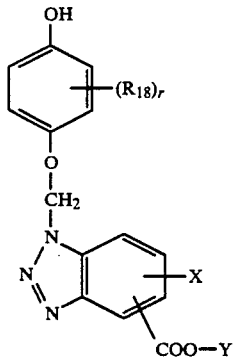
(XVII)
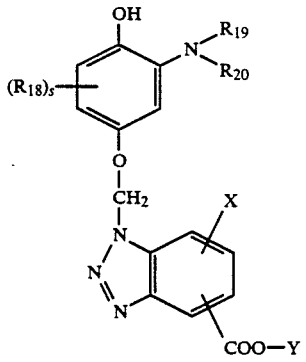
-continued
(XVIII)
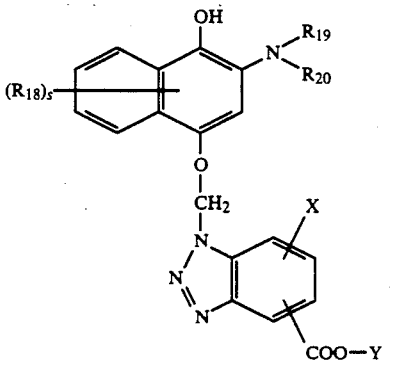
(XIX)
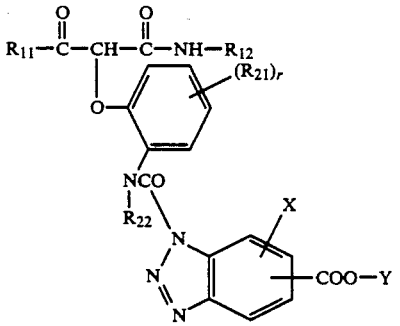
(XX)
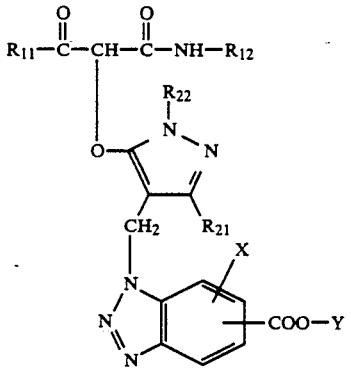
(XXI)
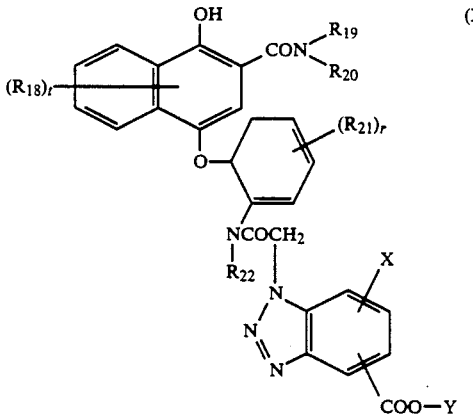

-continued

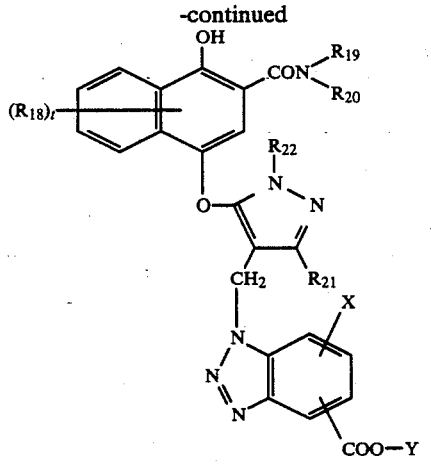

(XXII)

In the above described formulae, X, Y, $R_{21}$ and $R_{22}$ each has the same meaning as defined in the general formula (IV).

In the above described formulae, $R_{11}$ represents an aliphatic group, an aromatic group, an alkoxy group or a heterocyclic group; and $R_{12}$ and $R_{13}$ each represents an aromatic group or a heterocyclic group.

The aliphatic group represented by $R_{11}$ is preferably an aliphatic group containing from 1 to 22 carbon atoms, and may have substituents or not, and further, may have a chain form or a cyclic form. Preferable substituents therefor include an alkoxy group, an aryloxy group, an amino group, an acylamino group, a halogen atom, etc. which each may further have a substituent(s). Specific examples of aliphatic groups useful for $R_{11}$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

In the case that $R_{11}$, $R_{12}$ or $R_{13}$ represents an aromatic group (especially a phenyl group), it may have a substituent. Such an aryl group as a phenyl group, etc. may be substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido, alkyl-substituted succinimido group, etc. each containing 32 or less carbon atoms. The alkyl group therein may include an alkyl group which contains an aromatic group such as phenylene in its chain. Further, a phenyl group represented by $R_{11}$, $R_{12}$ or $R_{13}$ may be substituted with an aryloxy group, an aryloxycarbonyl group, an arylcarbamoyl group, an arylamido group, an arylsulfamoyl group, an arylsulfonamido group, an arylureido group, etc., the aryl moiety of which groups each may be substituted with one or more alkyl groups wherein the number of carbon atoms is from 1 to 22 in total.

Furthermore, a phenyl group represented by $R_{11}$, $R_{12}$ or $R_{13}$ may be substituted with an amino group which includes an amino group substituted with a lower alkyl group having from 1 to 6 carbon atoms, a hydroxy group, a carboxy group, a sulfo group, a nitro group, a cyano group, a thiocyano group or a halogen atom.

In addition, $R_{11}$, $R_{12}$ or $R_{13}$ may represent a substituent formed by condensing a phenyl group and another ring, to form a naphthyl group, a quinolyl group, an isoquinolyl group, a chromanyl group, a coumaranyl group, a tetrahydronaphthyl group, etc. These substituents may further have substituents in themselves.

In the case that $R_{11}$ represents an alkoxy group, the alkyl moiety thereof represents a straight chain or branched chain alkyl group having from 1 to 40 carbon atoms, preferably from 1 to 22 carbon atoms, an alkenyl group, a cyclic alkyl group or a cyclic alkenyl group, which each may be substituted with a halogen atom, an aryl group, an alkoxy group, etc.

In the case that $R_{11}$, $R_{12}$ or $R_{13}$ represents a heterocyclic group, the heterocyclic group is bonded to the carbon atom of the carbonyl group of the acyl moiety or the nitrogen atom of the amido moiety of an α-acylacetamido group through one of the carbon atoms forming the ring. Examples of such heterocyclic rings include thiophene, furan, pyran, pyrrole, pyrazole, pyridine, pyrazine, pyrimidine, pyridazine, indolizine, imidazole, thiazole, oxazole, triazine, thiadiazine, oxazine, etc. These rings may further have substituents on the individual rings.

In the above-described formula, $R_{15}$ represents a straight chain or branched chain alkyl group having from 1 to 40 carbon atoms, preferably from 1 to 22 carbon atoms (e.g., a methyl group, an isopropyl group, a tert-butyl group, a hexyl group, a dodecyl group, etc.), an alkenyl group (e.g., an allyl group, etc.), a cyclic alkyl group (e.g, a cyclopentyl group, a cyclohexyl group, a norbornyl group, etc.), an arlakyl group (e.g., a benzyl group, a β-phenylethyl group, etc.), a cyclic alkenyl group (e.g., a cyclopentenyl group, a cyclohexenyl group, etc.), etc., which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

$R_{15}$ may further represent an aryl group (e.g., a phenyl group, an α- or β-naphthyl group, etc.). The aryl group may have one or more substituents. Specific examples of the substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc. A more preferable group for $R_{15}$ is a phenyl group which is substituted with an alkyl group, an alkoxy group, a halogen atom, etc. at least at one of the o-positions, because it is effective to restrain coloration of couplers remaining in film layers due to light or heat.

Furthermore, $R_{15}$ may represent a heterocyclic group (e.g., a 5-membered or 6-membered heterocyclic ring containing as a hetero atom a nitrogen atom, an oxygen atom or a sulfur atom, or a condensed ring thereof, each specific examples including a pyridyl group, a quinolyl group, a furyl group, a benzothiazolyl group, an oxazolyl group, an imidazolyl group, a naphthoxazolyl group, etc.), a heterocyclic group substituted with one or more substituents as defined for the above-described aryl group, an aliphatic acyl group, an aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above-described general formulae, $R_{14}$ represents a hydrogen atom, a straight chain or branched chain alkyl group having from 1 to 40 carbon atoms, preferably from 1 to 22 carbon atoms, an alkenyl group, a cyclic alkyl group, an aralkyl group or a cyclic alkenyl group (which each may have one or more substituents as defined for the above-defined substituent $R_{15}$), an aryl group or a heterocyclic group (which each also may have one or more substituents as defined for the above-described substituent $R_{15}$), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an α-naphthylthio group, etc.), a carboxy group, an acylamino group (e.g., an acetylamino group, a 3-[(2,4-di-tert-amylphenoxy)acetamido]benzamido group, etc.), a diacylamino group, an N-alkylacylamino group (e.g., an N-methylpropionamido group, etc.), an N-arylacylamino group (e.g., an N-phenylacetamido group, etc.), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., a n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methylphenylcarbamoyl group, an N-phenylcarbamoyl, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxy group, a mercapto group, a halogen atom or a sulfo group.

In the above-described formulae, $R_{17}$ represents a hydrogen atom, or a straight chain or branched chain alkyl group having from 1 to 32 carbon atoms, preferably from 1 to 22 carbon atoms, an alkenyl group, a cyclic alkyl group, an aralkyl group or a cyclic alkenyl group, which each may have one or more substituents as defined for the above-described substituent $R_{15}$.

Further, $R_{17}$ may represent an aryl group or a heterocyclic group, which each may have one or more substituents as defined for the above-described substituent $R_{15}$.

Furthermore, $R_{17}$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

In the above-described formulae, $R_{18}$, $R_{19}$ and $R_{20}$ each represents a group which has been employed in conventional 4-equivalent type phenol or α-naphthol couplers. Specifically, $R_{18}$ represents a hydrogen atom, a halogen atom, an aliphatic hydrocarbon residue, an acylamino group, a $—NHCONR_{32}R_{33}$ group, a $—NHCOOR_{31}$ group, an $—O—R_{31}$ group or an $—S—R_{31}$ group (wherein $R_{31}$ is an aliphatic hydrocarbon residue, and $R_{32}$ and $R_{33}$ is an aliphatic hydrocarbon, an aryl group or a heterocyclic residue and each represents the same meaning as defined for $R_{19}$ and $R_{20}$). When two or more of $R_{18}$'s are present in one molecule, they may be different from each other. The above-described aliphatic hydrocarbon residues include those having substituents.

$R_{19}$ and $R_{20}$ each represents an aliphatic hydrocarbon residue, an aryl group or a heterocyclic group. Either of them may be a hydrogen atom. The above-described groups for $R_{19}$ and $R_{20}$ may further have certain substituents. Furthermore, $R_{19}$ and $R_{20}$ may combine with each other and form a nitrogen-containing heterocyclic nucleus. More specifically, the above-described aliphatic hydrocarbon residues include both saturated and unsaturated residues, wherein each may have a straight chain form, a branched chain form or a cyclic form. Preferred examples thereof include an alkyl group (e.g., a methyl group, an ethyl group, a propyl group, an isopropyl group, a butyl group, a tert-butyl group, an isobutyl group, a dodecyl group, an octadecyl group, a cyclobutyl group, a cyclohexyl group, etc.) and an alkenyl group (e.g., an allyl group, an octenyl group, etc.). The above-described aryl group includes a phenyl group, a naphthyl group, etc. Representatives of the above-described heterocyclic groups include a pyridinyl group, a quinolyl group, a thienyl group, a piperidyl group, an imidazolyl group, etc. These aliphatic hydrocarbon residues, aryl groups and heterocyclic groups each may be substituted with a halogen atom, a nitro group, a hydroxy group, a carboxy group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a cyano group, a morpholino group, etc.

In the above-described formulae, r represents an integer of 1 to 4, s represents an integer of 1 to 3, and t represents an integer of 1 to 5.

Substituents $R_{11}$, $R_{12}$, $R_{13}$, $R_{14}$, $R_{15}$, $R_{17}$, $R_{18}$, $R_{19}$ and $R_{20}$ in the couplers represented by the general formulae (XII) to (XXII) may combine with each other or each of them may make a divalent group to form symmetric or asymmetric complex couplers.

Specific examples of the hydrolizable type DIR couplers which can be used in the present invention are set forth below, but the present invention should not be construed as being limited thereto.

(1)

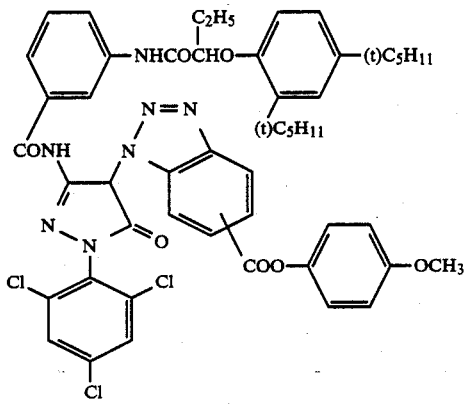

(2)

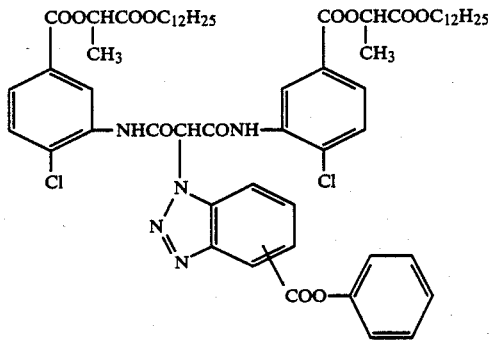

(3)

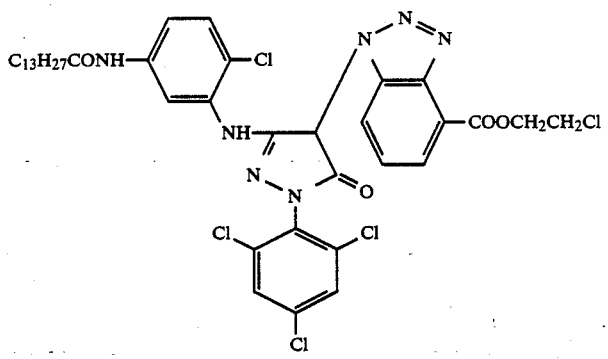

-continued
(4)
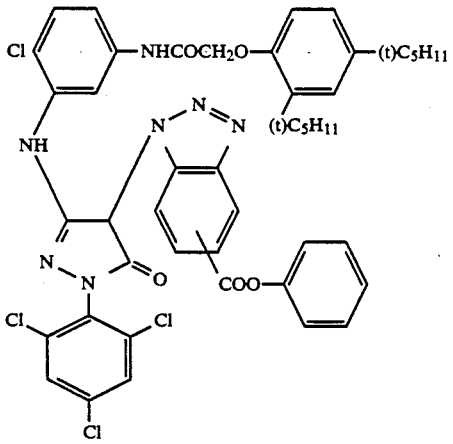
(5)
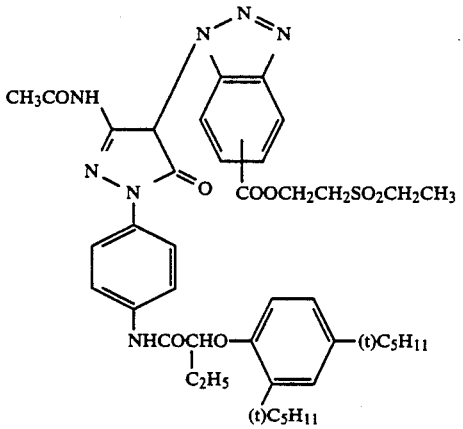
(6)
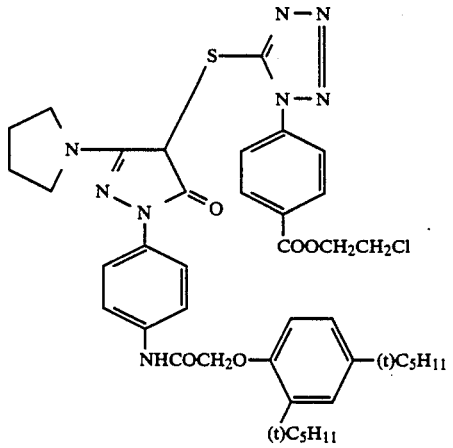
(7)
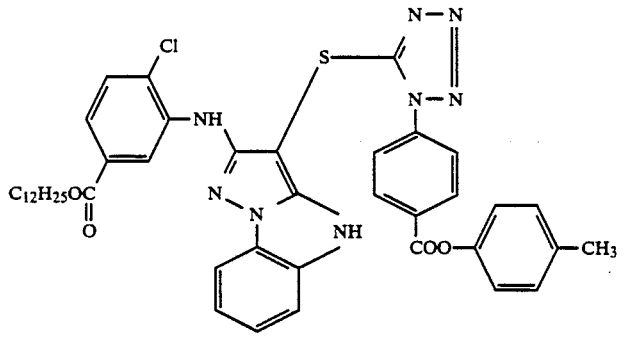

-continued
(8)
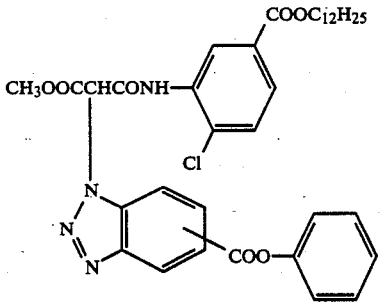
(9)
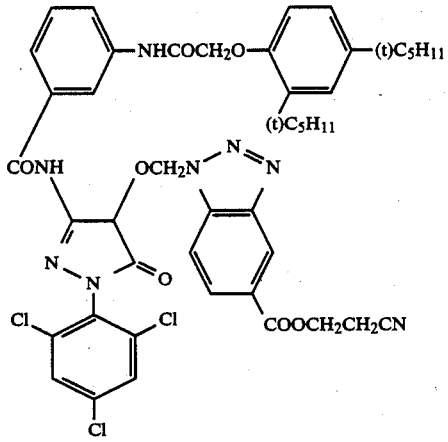
(10)
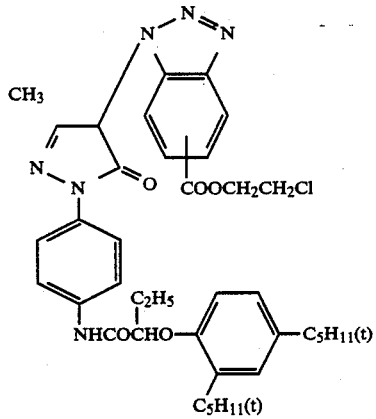
(11)
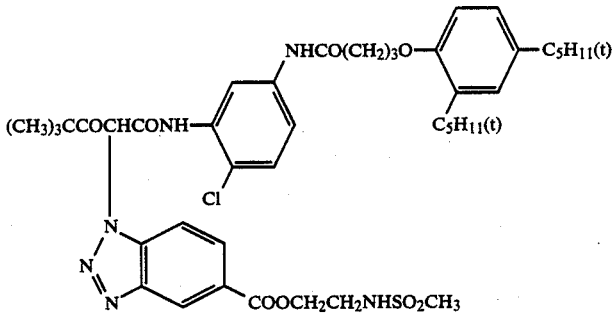

-continued
(12)
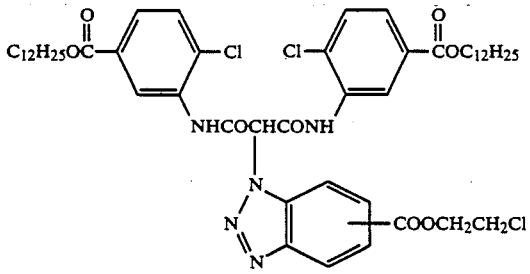
(13)
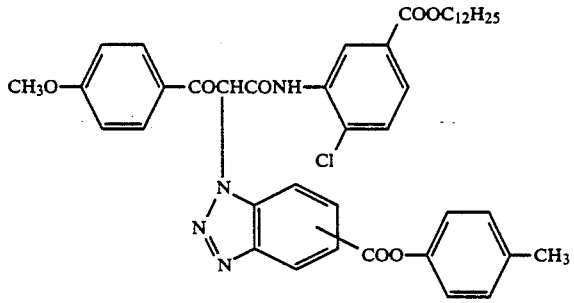
(14)
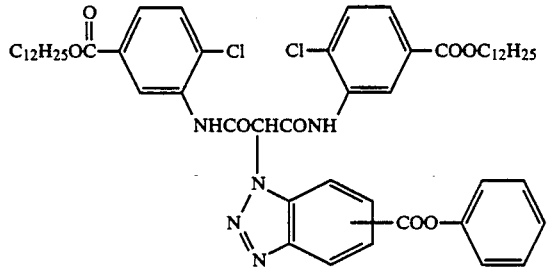
(15)
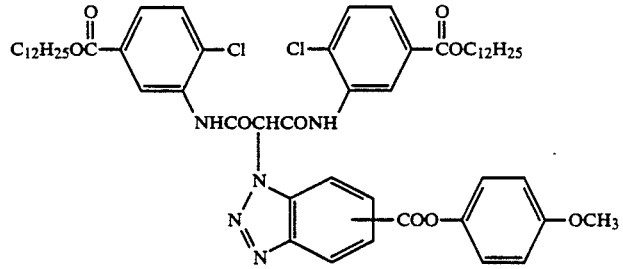
(16)
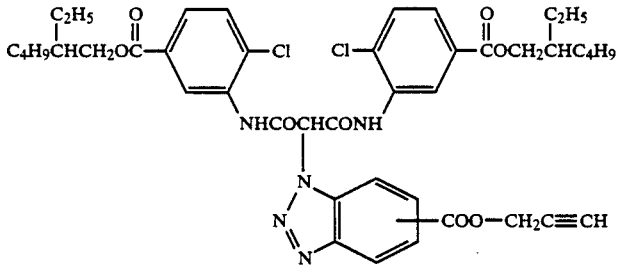

-continued
(17)
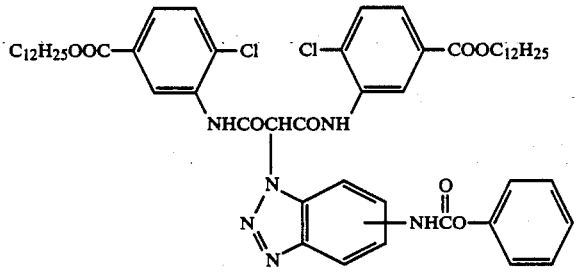
(18)
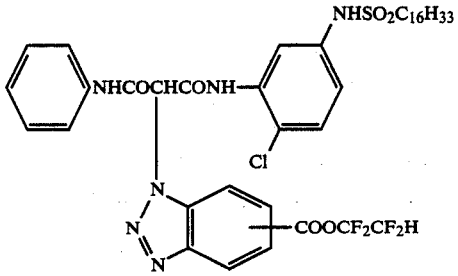
(19)
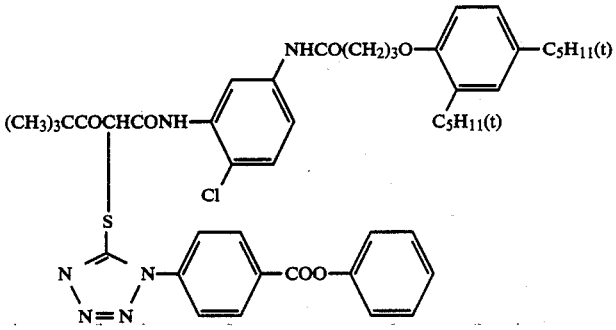
(20)
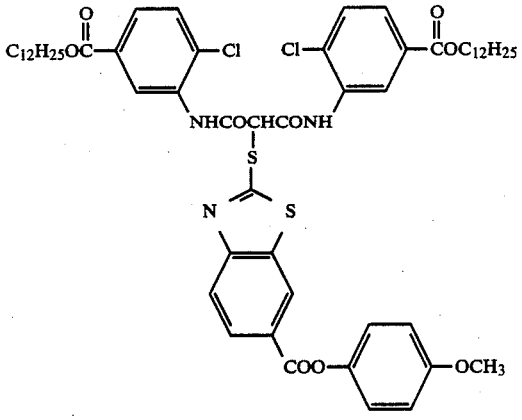
(21)
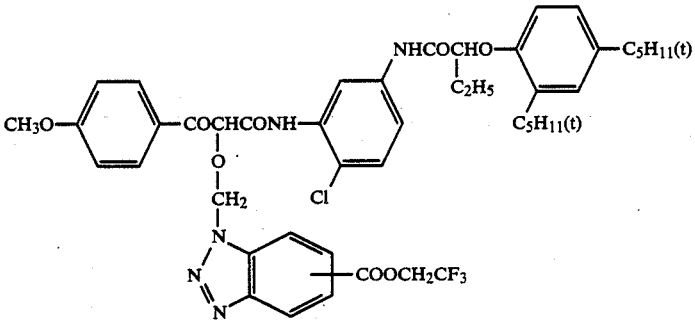

-continued
(22)
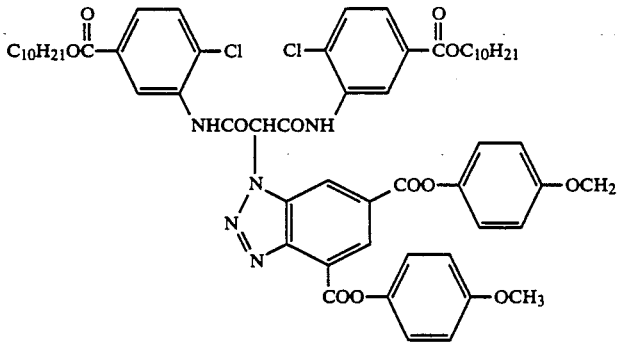
(23)
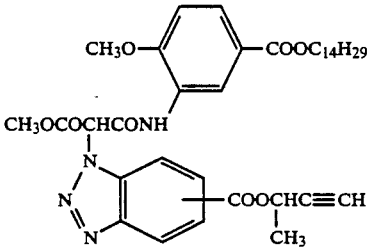
(24)
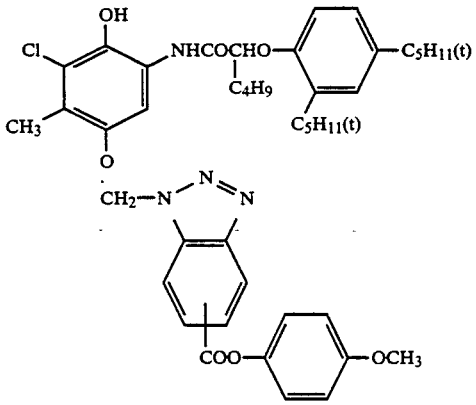
(25)
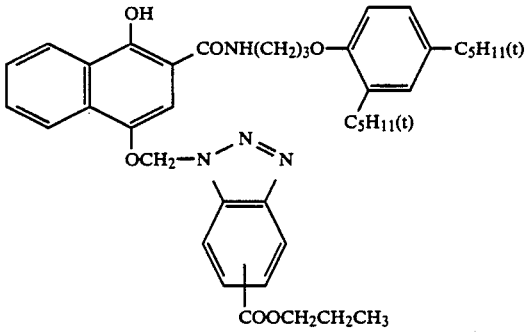
(26)
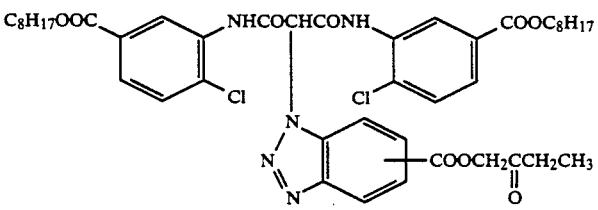

-continued
(27)
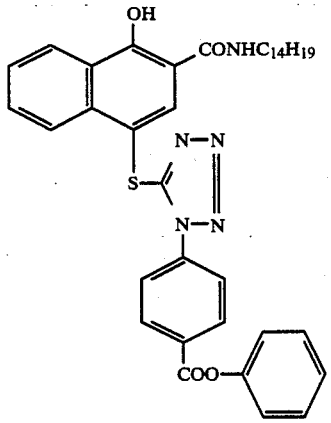
(28)
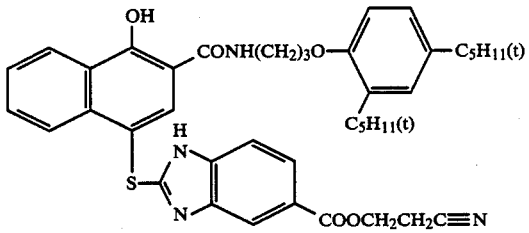
(29)
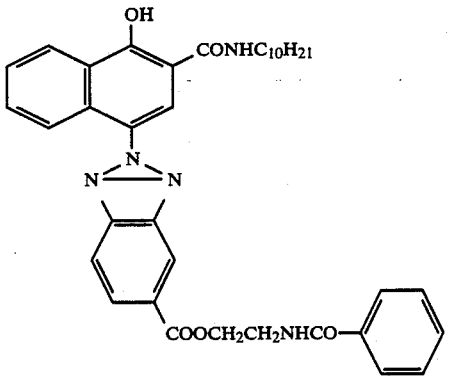
(30)
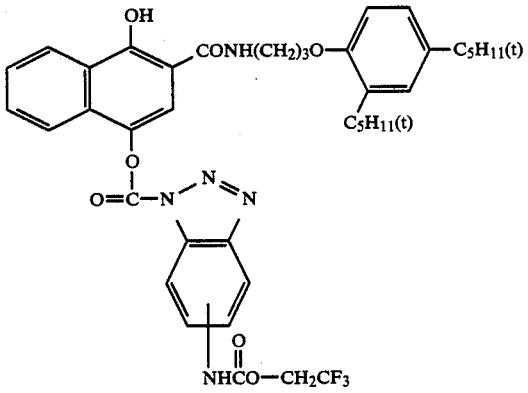

-continued
(31)
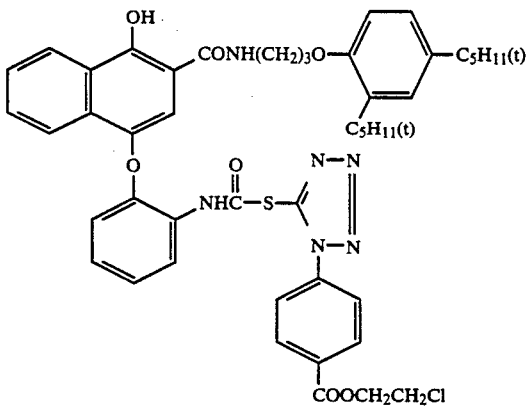
(32)
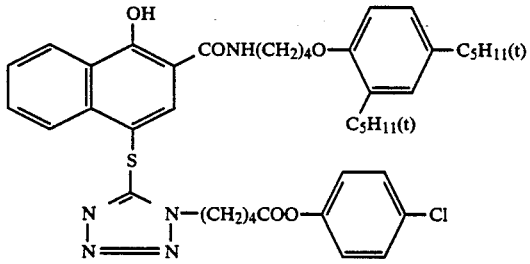
(33)
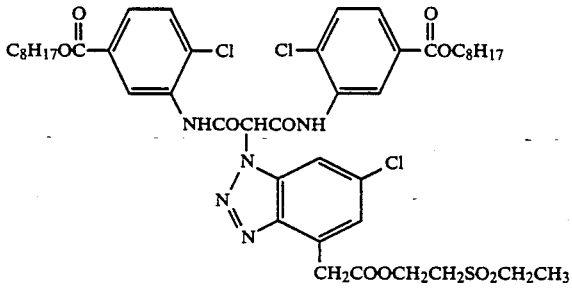
(34)
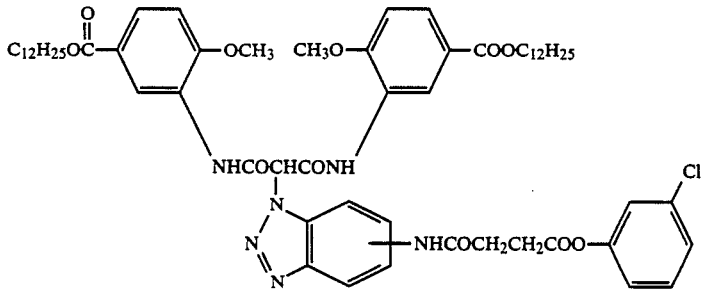
(35)
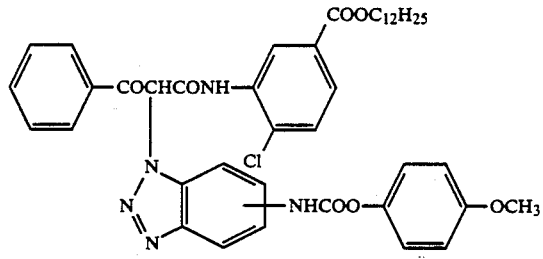

-continued
(36)
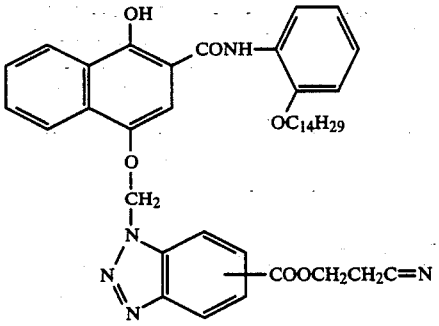
(37)
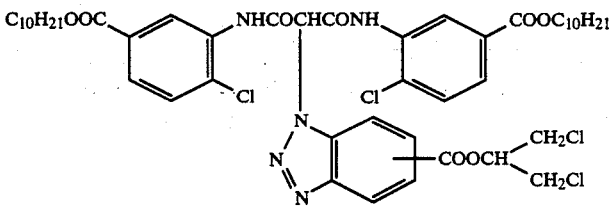
(38)
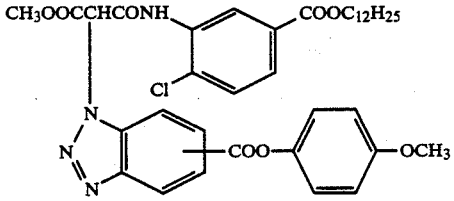
(39)
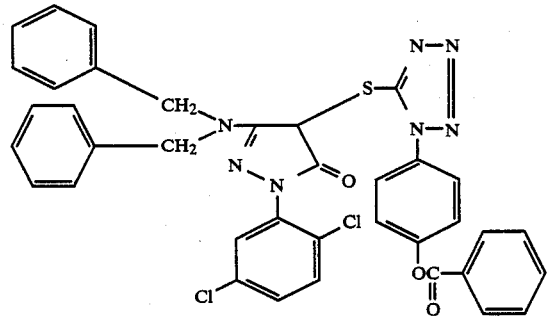
(40)
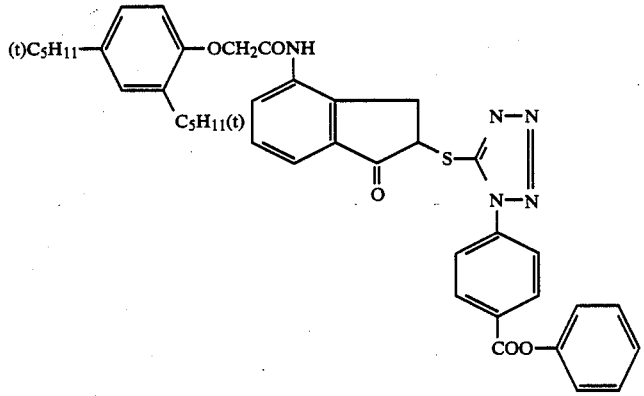

-continued
(41)
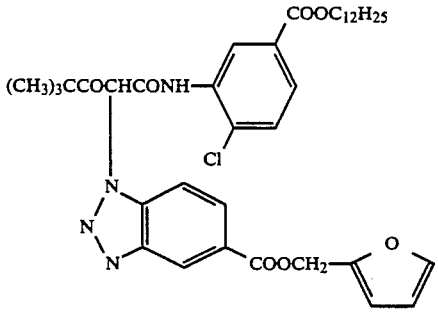
(42)
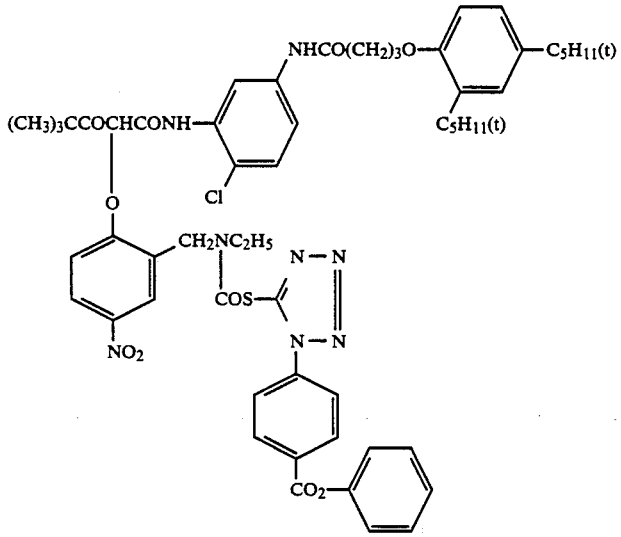
(43)
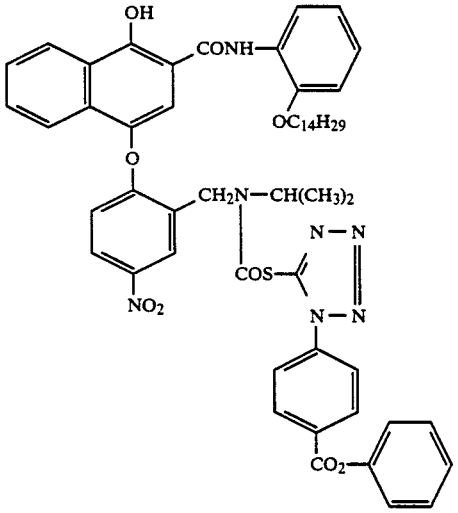

-continued
(44)
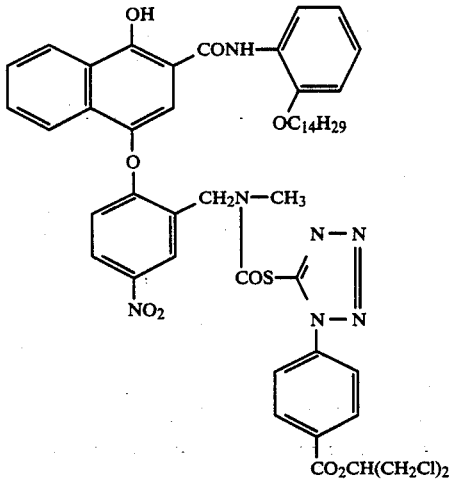
(45)
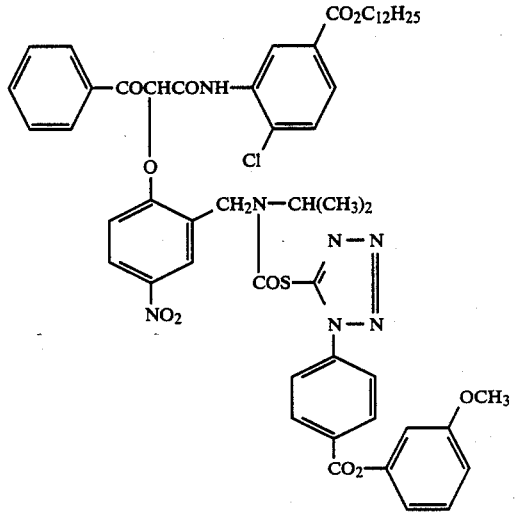
(46)
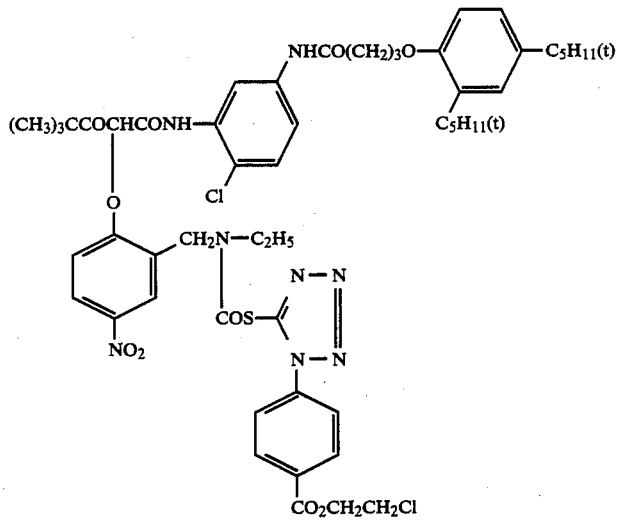

-continued
(47)
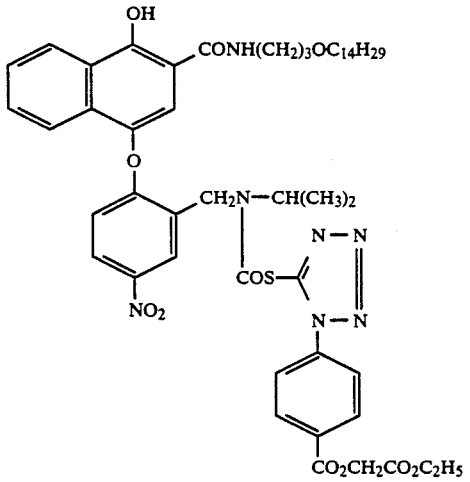
(48)
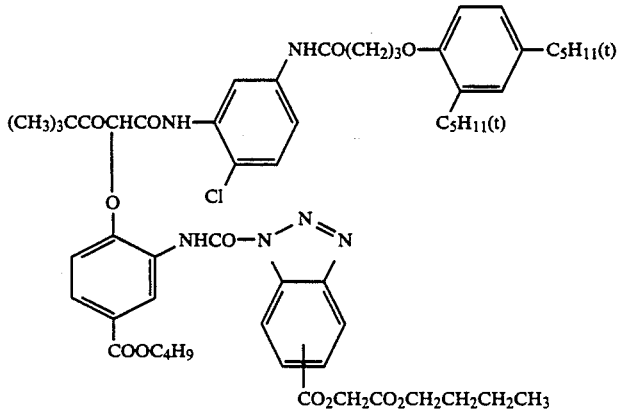
(49)
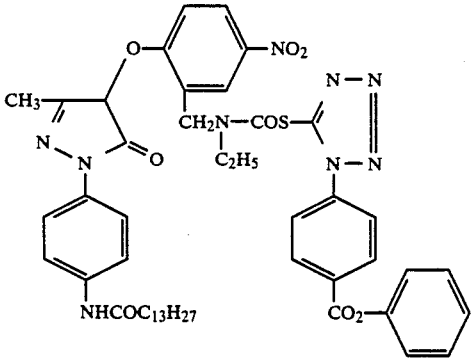
(50)
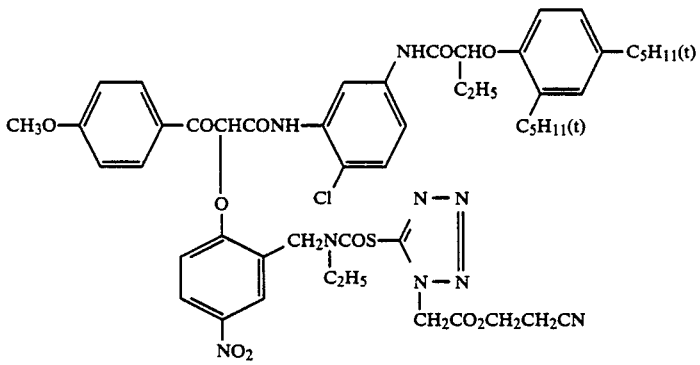

-continued
(51)
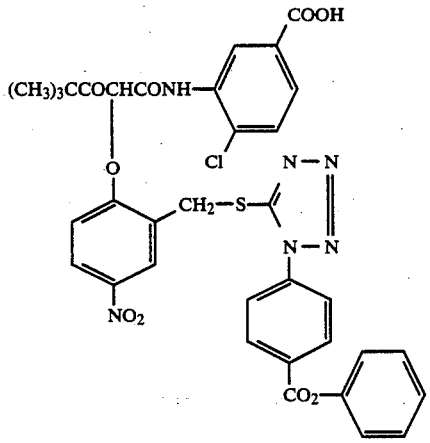
(52)
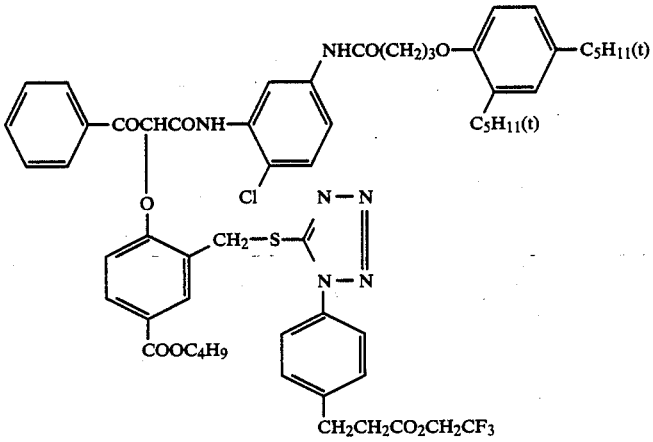
(53)
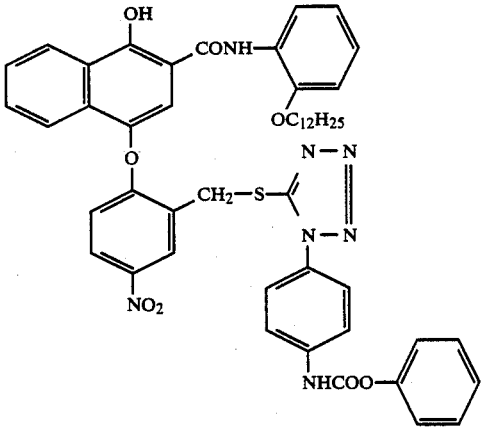

-continued
(54)
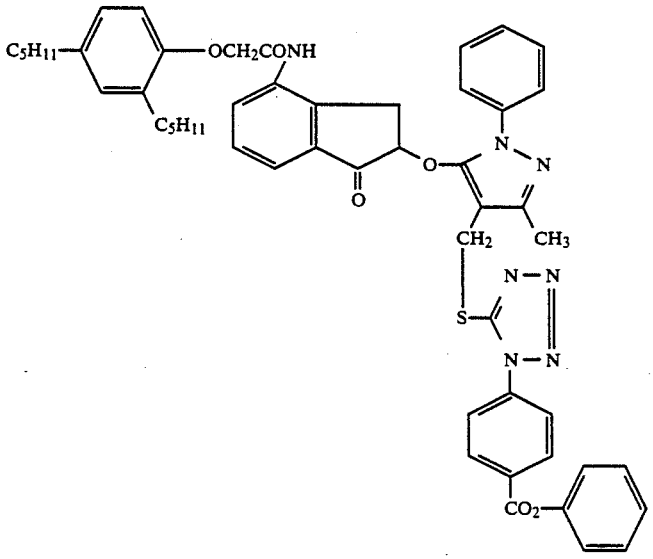
(55)
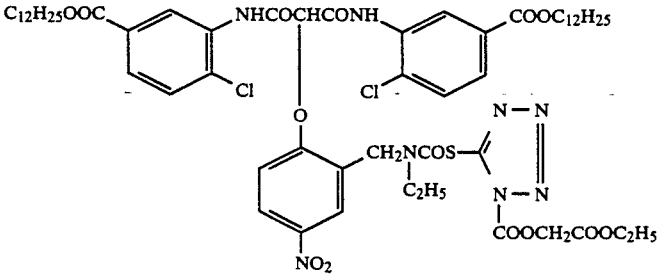
(56)
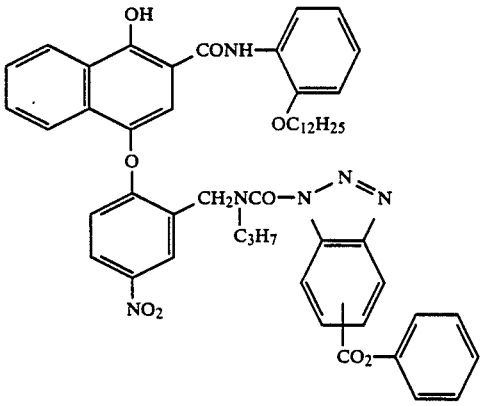

-continued (57)

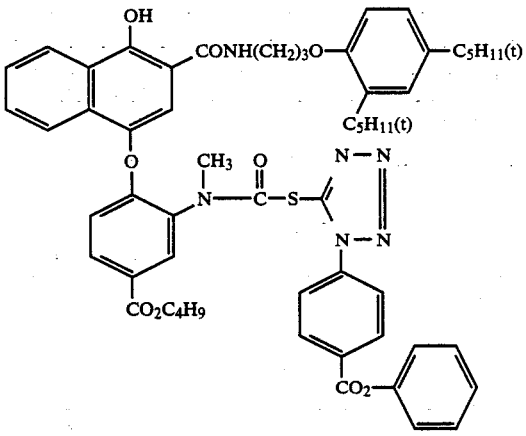

(58)

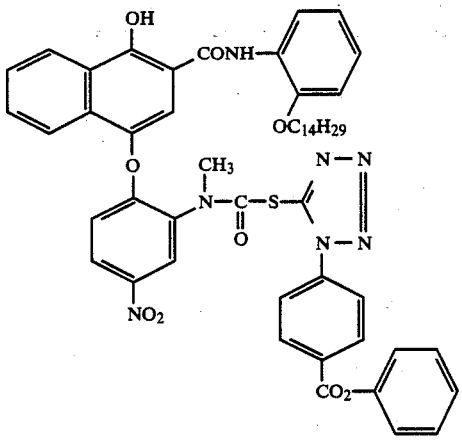

(59)

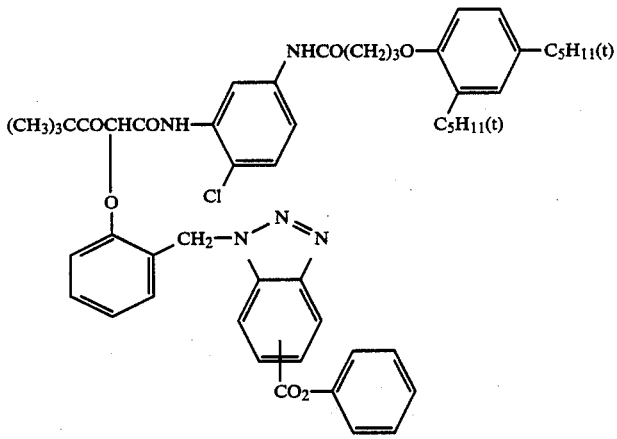

The hydrolizable type DIR couplers which can be employed in the present invention are known compounds and can be easily synthesized according to the methods as described, for example, in Japanese patent application (OPI) Nos. 151944/82 and 205150/83, etc.

The specific examples of the couplers described above each has a half-value period of 4 hours or less. The half-value period of these couplers can be easily determined by the method as described hereinbefore. The half-value periods determined are shown with respect to some couplers in the following table.

| Coupler No. | Half-Value Period (min) |
|---|---|
| (1) | 10 |
| (2) | 4.5 |
| (3) | 120 |
| (4) | 4.5 |
| (6) | 120 |
| (7) | 11 |
| (8) | 4.5 |
| (9) | 3 |
| (15) | 11 |
| (16) | 20 |
| (18) | 4.3 |

-continued

| Coupler No. | Half-Value Period (min) |
|---|---|
| (37) | 30 |
| (43) | 4.5 |

The hydrolizable type DIR coupler may be incorporated into either a light-sensitive emulsion layer or a light-insensitive layer. A preferred amount of the DIR coupler to be added is in a range from $1\times10^{-4}$ mol to $1\times10^{-1}$ mol per mol of the total coating amount of silver.

Now, the non-hydrolizable type DIR couplers represented by the general formula (I) described hereinbefore will be described in detail below.

In the general formula (I), A and $(L_1)_a$ each has the same meaning as defined for A and $(L_1)_a$ in the general formula (IV) described above.

$Z_1$ represents a development inhibiting component, a development inhibitor of which is not hydrolized in a color developing solution. Specific examples thereof include those capable of releasing a development inhibitor upon an intramolecular nucleophilic displacement reaction as described in Japanese patent application (OPI) No. 145135/79 and these capable of releasing a development inhibitor upon electron transfer via a conjugated chain as described in Japanese patent application (OPI) No. 114946/81.

Specific examples of $Z_1$ include the development inhibitors as described in Research Disclosure, Vol. 176, No. 17643 (December, 1978) and preferably a mercaptotetrazole, a mercaptobenzothiazole, a mercaptobenzoxazole, a mercaptobenzimidazole, a benzotriazole, a benzodiazole and derivatives thereof.

Specific examples of the non-hydrolizable type DIR couplers represented by the general formula (I) which can be used in the present invention are set forth below, but the present invention should not be construed as being limited thereto.

D-1

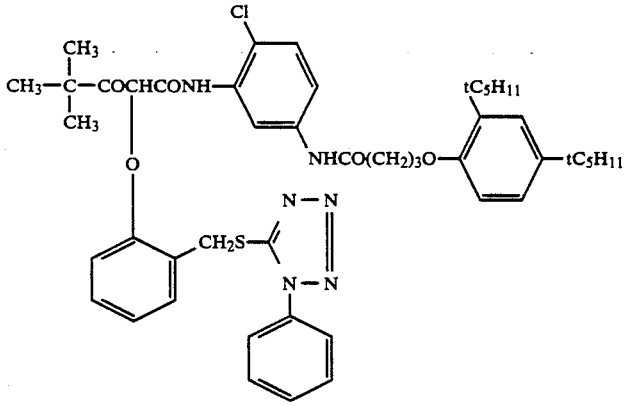

D-2

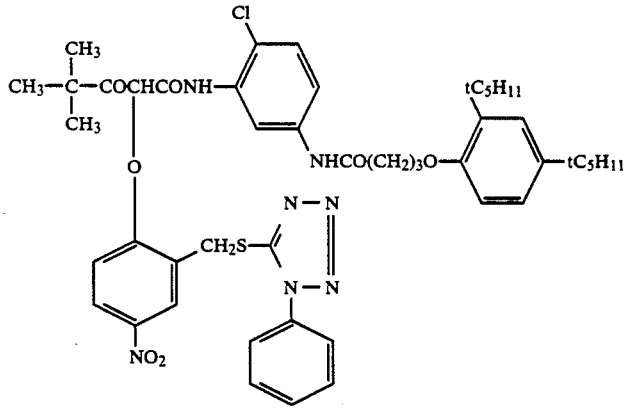

-continued
D-3
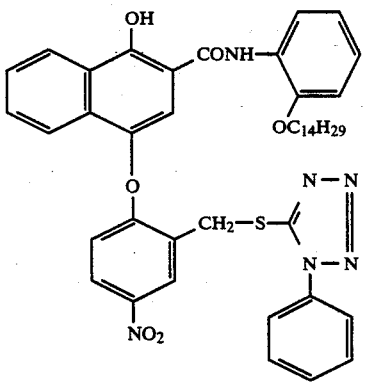
D-4
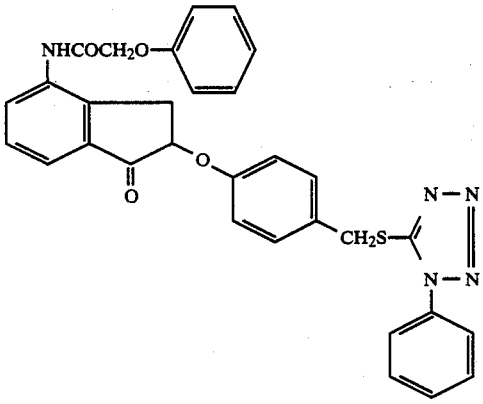
D-5
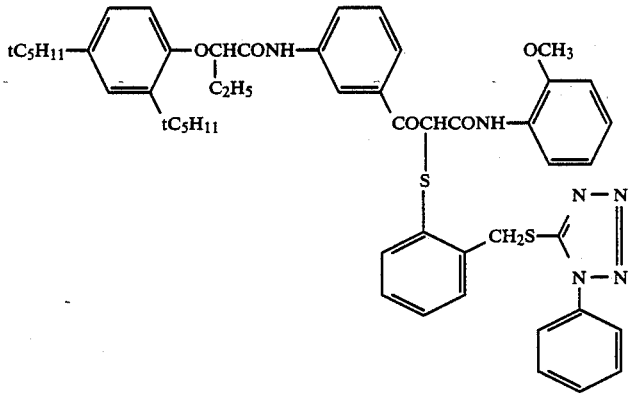
D-6
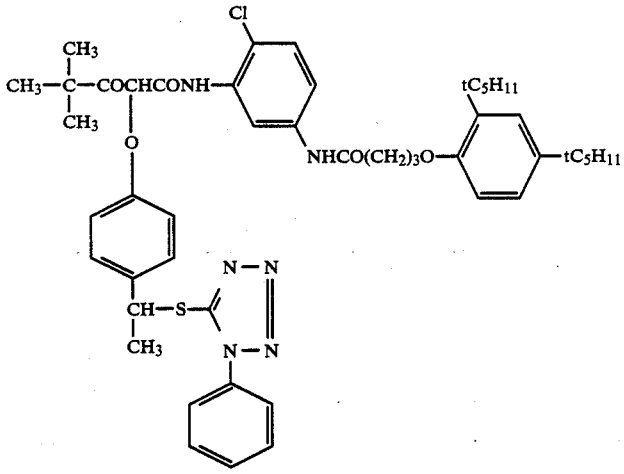

-continued
D-7
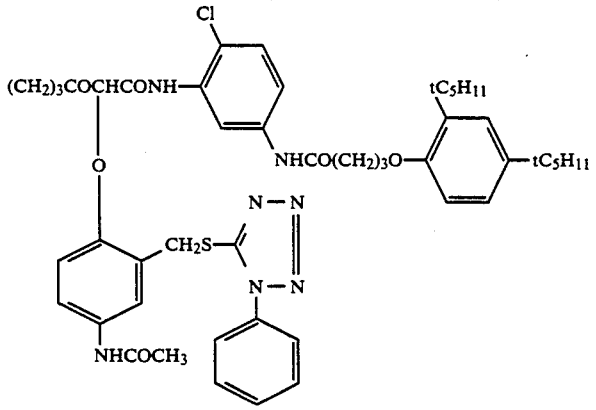
D-8
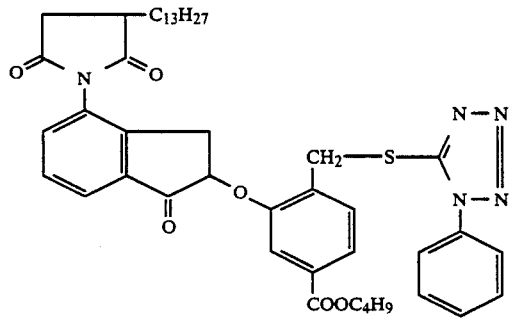
D-9
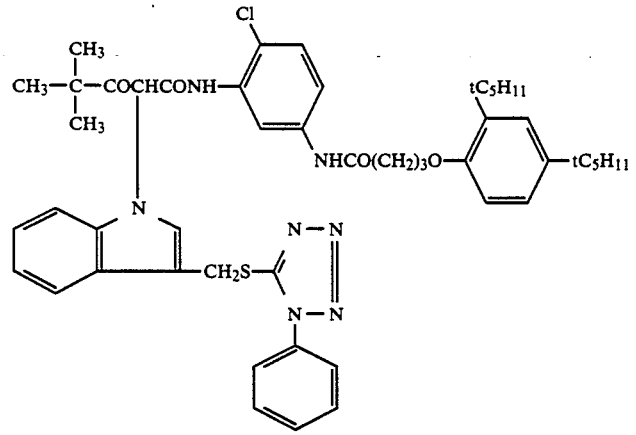
D-10
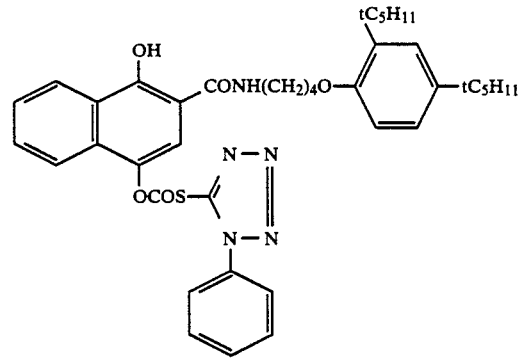

-continued
D-11
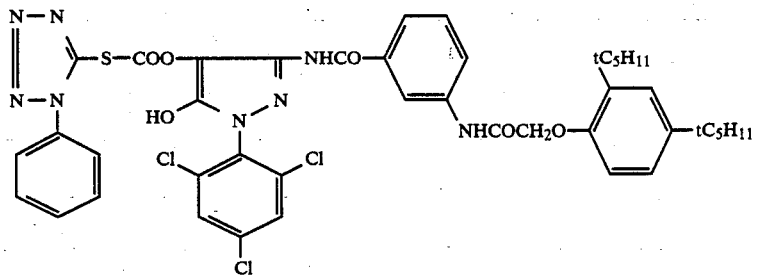
D-12
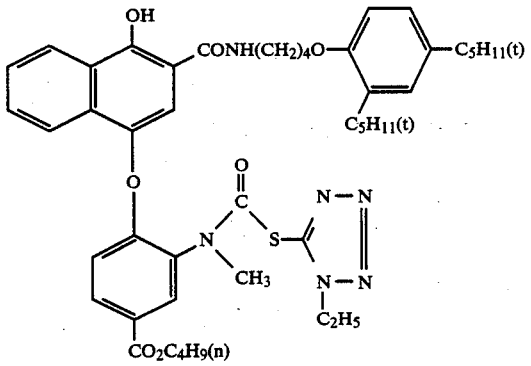
D-13
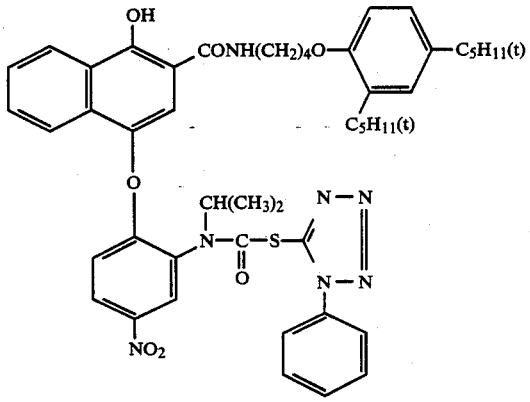
D-14
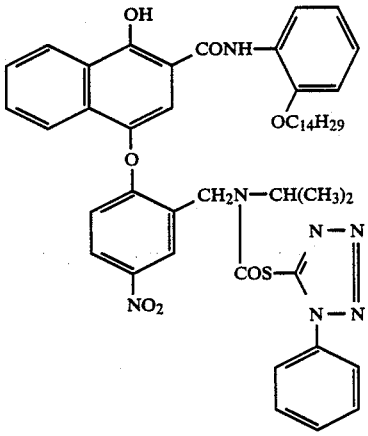

-continued
D-15
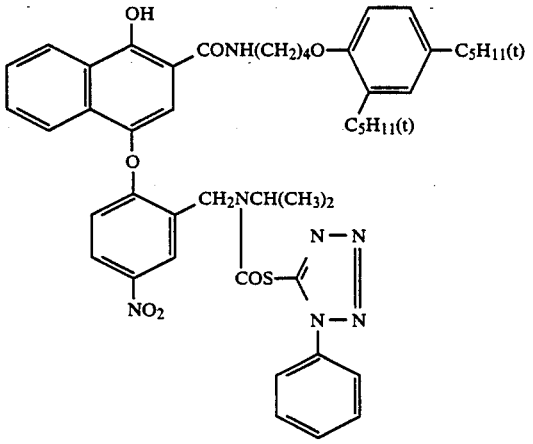
D-16
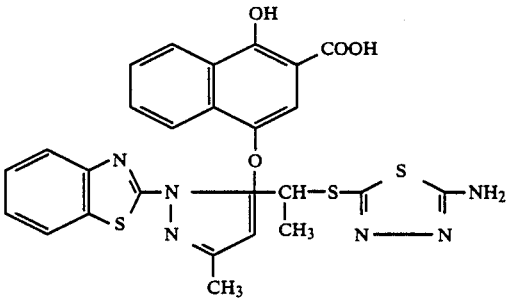
D-17
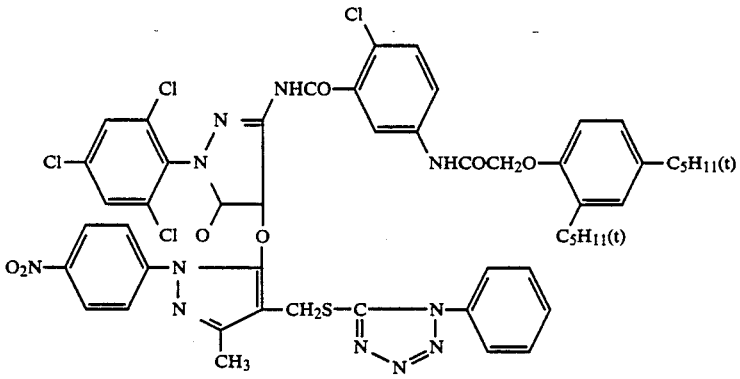
D-18
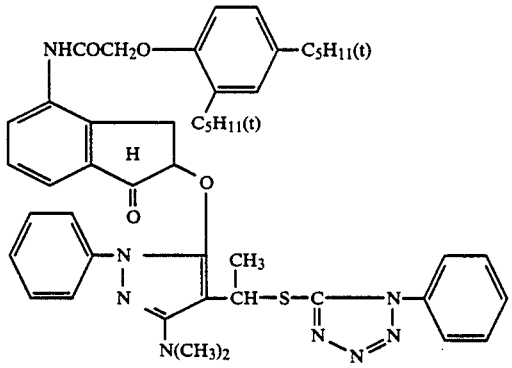

-continued
D-19
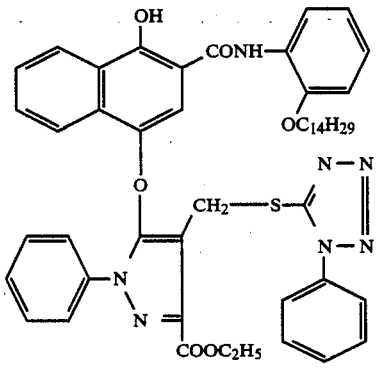
D-20
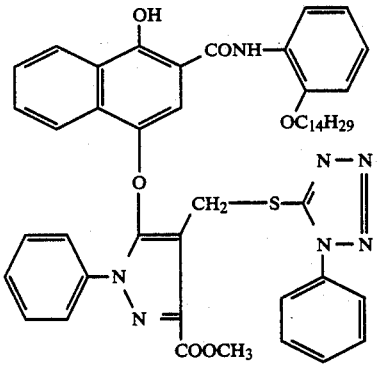
D-21
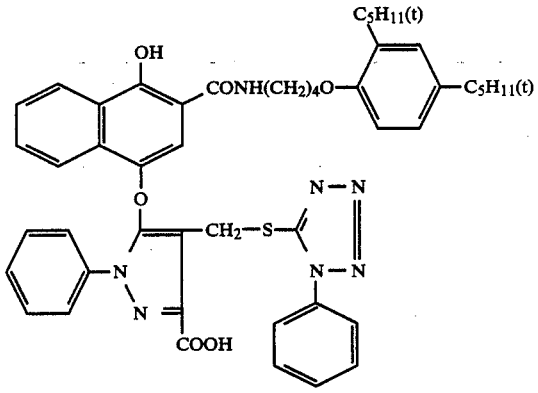
D-22
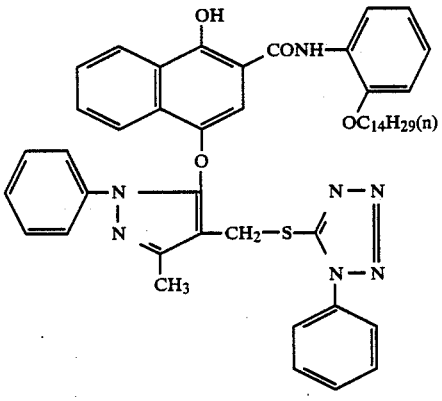

-continued
D-23
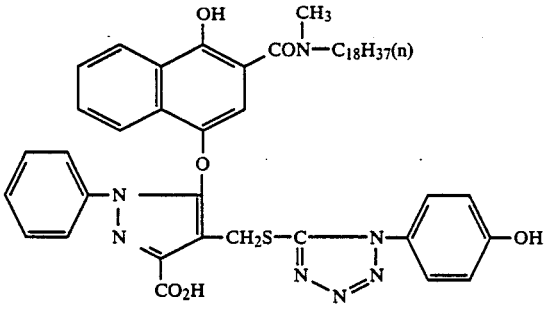
D-24
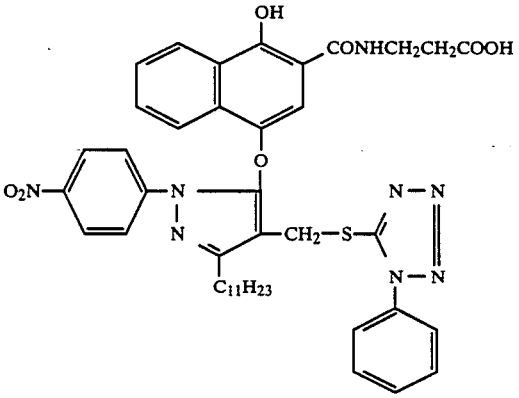
D-25
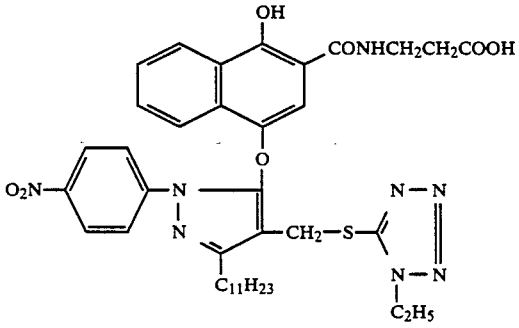
D-26
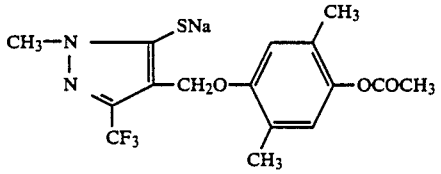
D-27
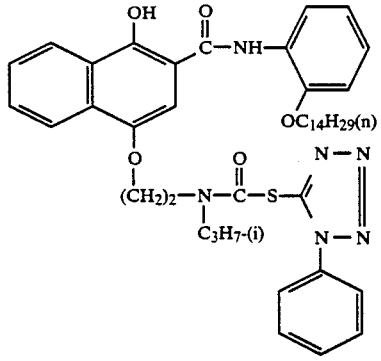

-continued
D-28
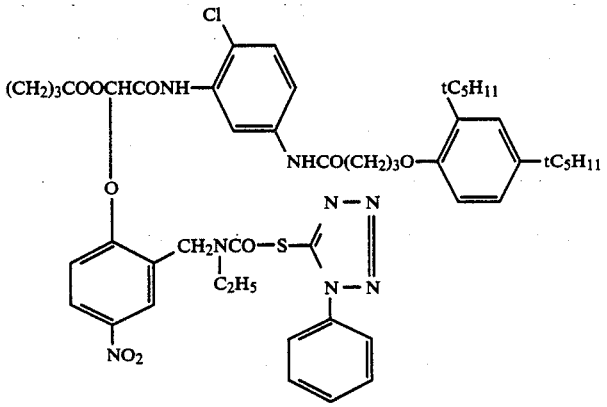
D-29
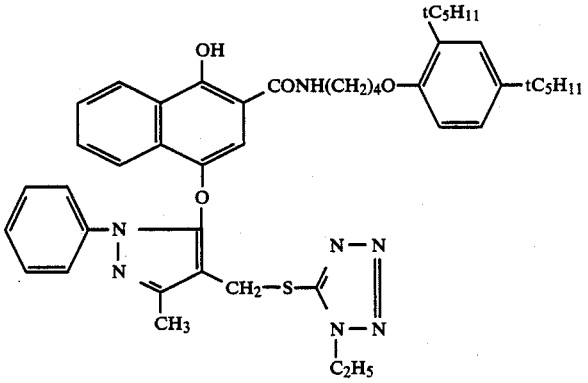
D-30
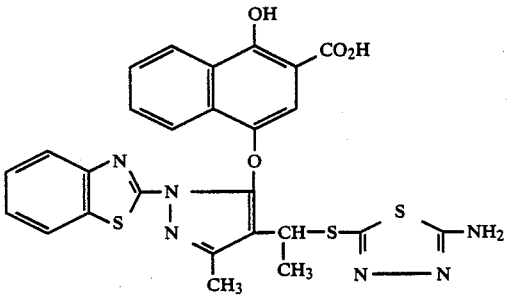
D-31
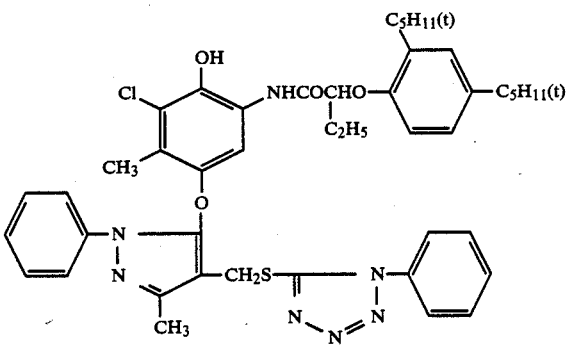

-continued
D-32
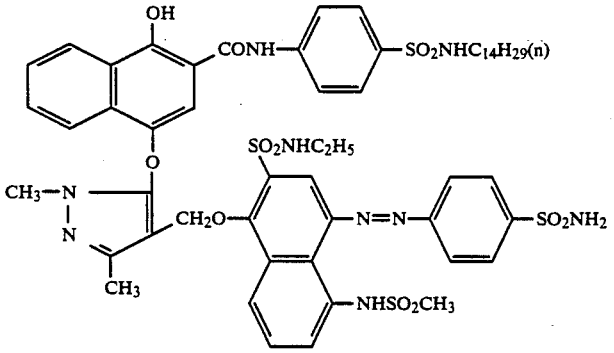
D-33
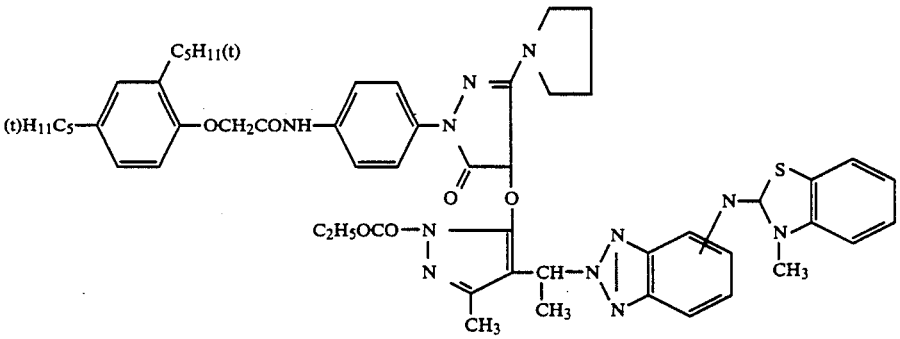
D-34
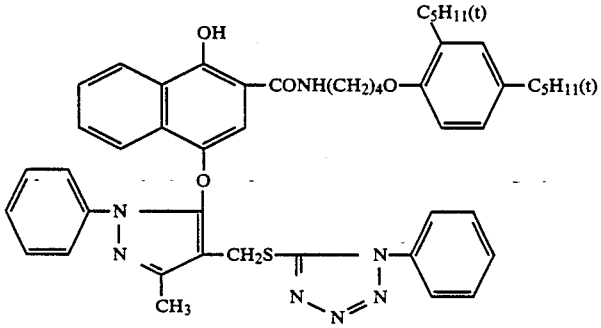
D-35
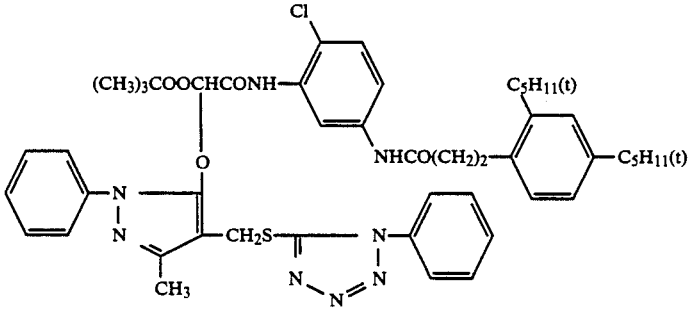
D-36
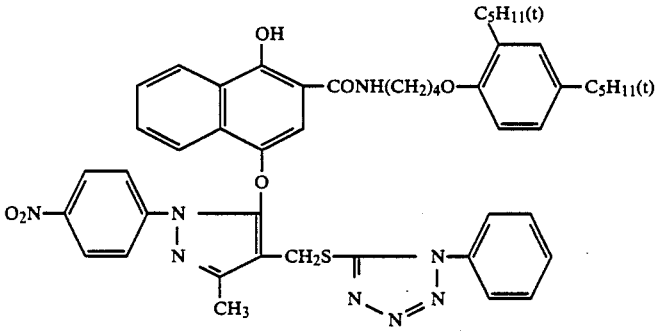

-continued

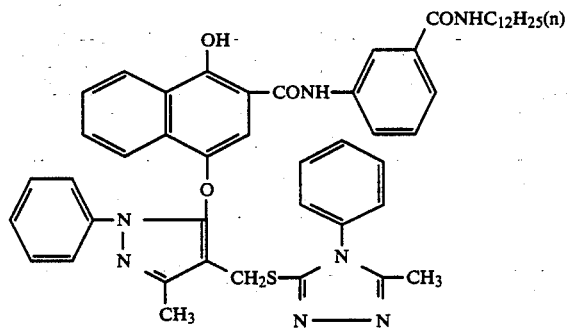

D-37

According to the present invention, known various kinds of techniques can be applied in order to incorporate the above described couplers into a light-sensitive layer. Ordinarily, they may be incorporated by an oil-in-water dispersion method which is known as the oil protected method. More specifically, the couplers are dissolved in organic solvent having a high boiling point, for example, a phthalic acid ester such as dibutyl phthalate, dioctyl phthalate, etc., a phosphoric acid ester such as tricresyl phosphate, trinonyl phosphate, etc., or the like, or an organic solvent having a low boiling point such as ethyl acetate, etc. or in a mixture of these solvents, and then emulsified and dispersed in an aqueous solution of gelatin containing a surface active agent. Alternatively, water or an aqueous solution of gelatin was added to a solution of coupler containing a surface active agent, followed by a phase inversion to prepare an oil-in-water dispersion. From the coupler dispersion the organic solvent having a low boiling point may be removed, if desired, by an appropriate method such as distillation, noodle washing or ultrafiltration, etc. and thereafter it is mixed with a photographic silver halide emulsion.

In the silver halide emulsion layer of the color photographic material according to the present invention, various kinds of silver halide can be employed. For example, silver chloride, silver bromide, silver chlorobromide, silver iodobromide or silver chloroiodobromide, etc. can be used. Silver iodobromide containing from 2 to 20 mol % of silver iodide and silver chlorobromide containing from 10 to 50 mol % of silver bromide are preferred. Crystal form, crystal structure, particle size and particle size distribution, etc. of silver halide particles are not particularly limited. Crystals of silver halide may be any of normal structure and twin structure, and may be any of hexahedron, octahedron and tetradecahedron. Further, tabular silver halide particles having the thickness of 0.5 microns or less, the diameter of at least 0.6 microns and the mean aspect ratio of 5 or more can be used.

Silver halide of uniform crystal structure, silver halide having different compositions in inner portions and outer portions, silver halide of layer structure, silver halide combined with silver halide having a different composition with an epitaxial junction, or silver halide composed of a mixture of various crystal forms may be used. Further, silver halide particles in which latent images are formed mainly on the surface thereof or those in which latent images are formed mainly in the interior thereof may be used.

The particle size of silver halide can be varied and either fine grains of 0.1 micron or less or large size grains of up to 3 microns in diameter calculated from projected areas can be employed. Also monodisperse emulsions having a narrow distribution or polydisperse emulsions having a broad distribution may be used.

These silver halide particles can be prepared by known methods conventionally used in the photographic art.

The above described silver halid emulsion can be sensitized by means of a conventional chemical sensitization, that is a sulfur sensitization process, a noble metal sensitization method, or a combination thereof. Further, the silver halide emulsion according to the present invention can be imparted with spectral sensitivity at desired wavelength ranges using sensitizing dyes. Examples of sensitizing dyes advantageously used in the present invention include methine dyes and styryl dyes such as cyanine dyes, hemicyanine dyes, rhodacyanine dyes, merocyanine dyes, oxonol dyes, hemioxonol dyes, etc. These dyes can be used individually or in combinations of two or more thereof.

Further, to the silver halide emulsion layer or other hydrophilic colloid layers, substantially light-insensitive fine grain silver halide emulsions (for example, a silver chloride, silver bromide or silver chlorobromide emulsion having the average particle size of 0.20 $\mu$ or less) may be added, if desired.

The magenta coupler according to the present invention can be utilized in combination with a cyan coupler and a yellow coupler for the purpose of preparing a natural color photographic light-sensitive material. Further, it can be employed to prepare a black and white photographic light-sensitive material by selecting these couplers so as to provide neutral gray color. The magenta coupler according to the present invention may be used together with an equal molar amount or less of conventionally known magenta couplers.

These couplers which can be used together may be either four-equivalent or two-equivalent with respect to silver ion. Also, colored couplers having a color collection effect or couplers capable of releasing a development inhibitor (so-called DIR couplers) may be employed together.

Further, the photographic light-sensitive material may contain a non-color forming DIR coupling compound which forms a colorless coupling reaction product and releases a development inhibitor, other than DIR couplers.

In the present invention, various kinds of color couplers can be employed together. Typical examples of useful color couplers include naphthol or phenol type compounds, pyrazolone or pyrazoloazole type compounds and open-chain or heterocyclic keto-methylene type compounds. Specific examples of utilizable cyan, magenta and yellow couplers in the present invention are described in the patents cited in *Research Disclosure*, No. 17643, VII-D (December, 1978) and ibid., No. 18717 (November, 1979).

It is preferable that color couplers incorporated into the photographic light-sensitive material are diffusion resistant by means of containing a ballast group or polymerizing. Further, two-equivalent color couplers the coupling position of which is substituted with a group capable of being released are preferred in comparison with four-equivalent color couplers the coupling position of which is substituted by a hydrogen atom since the coating amount of silver is reduced and high sensitivity is achieved. Also, couplers which form colored dyes having an appropriate diffusibility, non-color forming couplers, or couplers capable of releasing development inhibitors (DIR couplers) or development accelerators accompanying the coupling reaction can be employed.

As typical yellow couplers used together in the present invention, oil protected acylacetamide type couplers are exemplified. Specific examples thereof are described in U.S. Pat. Nos. 2,407,210, 2,875,057 and 3,265,506, etc. In the present invention, two-equivalent yellow couplers are preferably employed and typical examples thereof include yellow couplers of oxygen atom releasing type as described in U.S. Pat. Nos. 3,408,194, 3,447,928, 3,933,501 and 4,022,620, etc. and yellow couplers of nitrogen atom releasing type as described in Japanese patent publication No. 10739/83, U.S. Pat. Nos. 4,401,752 and 4,326,024, *Research Disclosure*, No. 18053 (April, 1979), British Pat. No. 1,425,020, West German patent application (OLS) Nos. 2,219,917, 2,261,361, 2,329,587 and 2,433,812, etc. α-Pivaloylacetanilide type couplers are characterized by excellent fastness, particularly light fastness of dyes formed, and α-benzoylacetanilide type couplers are characterized by providing high color density.

As magenta couplers used together in the present invention, oil protected indazolone type couplers, cyanoacetyl type couplers, and preferably 5-pyrazolone type couplers and pyrazoloazole type couplers such as pyrazolotriazoles are exemplifed. Of 5-pyrazolone type couplers, those substitutes with an arylamino group or an acylamino group at the 3-position thereof are preferred in view of the hue of the dyes formed and the color density obtained. Typical examples thereof are described in U.S. Pat. Nos. 2,311,082, 2,343,703, 2,600,788, 2,908,573, 3,062,653, 3,152,896 and 3,936,015, etc. Two-equivalent 5-pyrazolone type couplers are preferably used and nitrogen atom releasing groups as described in U.S. Pat. No. 4,310,619 and arylthio groups as described in U.S. Pat. No. 4,351,897 are preferred as releasing groups. Further, 5-pyrazolone type couplers having a ballast group as described in European Pat. No. 73,636 are advantageous because high color density is obtained.

Examples of pyrazoloazole type couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure* No. 24220 (June, 1984) and pyrazolopyrazoles as described in *Research Disclosure*, No. 24230 (June, 1984). Imidazo[1,2-b]pyrazoles as described in European Pat. No. 119,741 and pyrazolo[1,5-b][1,2,4]triazoles as described in Europen Pat. No. 119,860 are particularly preferred in view of less yellow subsidiary absorption and light fastness of dyes formed.

As cyan couplers used together in the present invention, oil protected naphthol type and phenol type couplers are exemplified. Typical examples thereof include naphthol type couplers as described in U.S. Pat. No. 2,474,293 and preferably oxygen atom releasing type, two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers fast to humidity and temperature are preferably used in the present invention. Typical examples thereof include phenol type cyan couplers as described in U.S. Pat. No. 3,772,002, 2,5-diacylamino-substituted phenol type couplers as described in 2,772,162, 3,758,308, 4,126,396, 4,334,011 and 4,327,173, West German patent application (OLS) No. 3,329,729 and Japanese patent application No. 42671/83, etc. and phenol type couplers having a phenyl ureido group at the 2-position thereof and an acylamino group at the 5-position thereof as described in U.S. Pat. Nos. 3,446,622, 4,333,999, 4,451,559 and 4,427,767, etc.

It is preferred to use colored couplers together in color photographic light-sensitive materials for photographing in order to correct undesirable absorptions in shorter wavelength regions which dyes formed from magenta couplers and cyan couplers used have. Typical examples include yellow-colored magenta couplers as described in U.S. Pat. No. 4,163,670, and Japanese patent publication No. 39413/82, etc. and magenta-colored cyan couplers as described in U.S. Pat. Nos. 4,004,929 and 4,138,258, and British Pat. No. 1,146,368, etc.

Further, couplers capable of forming diffusible dyes can be used together in order to improve graininess. Specific examples of such smearing types of magenta couplers are described in U.S. Pat. No. 4,366,237 and British Pat. No. 2,125,570, etc. and those of yellow, magenta and cyan couplers are described in European Pat. No. 96,570 and West German patent application (OLS) No. 3,234,533, etc.

Two or more kinds of various couplers used in the present invention described above can be incorporated together in the same layer for the purpose of satisfying the properties required to the photographic light-sensitive materials, or the same compound can be added to different two or more layers.

Any of a transparent support such as a polyethylene terephthalate film or a cellulose triacetate film, etc. and a reflective support as described below can be utilized as a support for the present invention. Reflective supports include, for example, barita coated paper, polyethylene coated paper, polypropylene type synthetic paper, a transparent support having applied thereto a reflective layer or using together with a reflecting substance, for example, a glass plate, a polyester film such as a polyethylene terephthalate film, a cellulose triacetate film or a cellulose nitrate film, etc., a polyamide film, a polycarbonate film, a polystyrene film, etc. Suitable supports can be appropriately selected depending on the purpose for use.

In the color photographic light-sensitive material of the present invention, a subsidiary layer such as a subbing layer, an intermediate layer, a protective layer can be provided in addition to the silver halide emulsion layer. Further, an ultraviolet ray absorbing layer may be provided at a position farther from the support than the emulsion layer or between a red-sensitive silver halide emulsion layer and a green-sensitive silver halide emulsion layer, if desired.

Gelatin is advantageously used as binders or protective colloids for photographic emulsions, but other hydrophilic colloids can also be used.

As gelatin, not only lime processed gelatin but also acid processed gelatin and enzyme processed gelatin as described in *Bulletin of the Society of Scientific Photography of Japan,* No. 16, page 30 (1966) may be used. Further, hydrolyzed products or enzymatic decomposition products of gelatin can also be used.

In the photographic light-sensitive material of the present invention, the photographic emulsion layers and other hydrophilic colloid layers may contain whitening agents such as stilbene type, triazine type, oxazole type or coumarine type whitening agents. They may be water-soluble, and water-insoluble whitening agents may be used in the form of a dispersion. Specific examples of suitable fluorescent whitening agents are described in U.S. Pat. Nos. 2,632,701, 3,269,840, and 3,359,102, British Pat. Nos. 852,075 and 1,319,763 and *Research Disclosure,* Vol. 176, No. 17643, page 24, left column, lines 9 to 36, "Brighteners" (December, 1978), etc.

In the photographic light-sensitive material of the invention, when dyes, ultraviolet ray absorbing agents, and the like are incorporated into the hydrophilic colloid layers, they may be mordanted with cationic polymers, etc.

The photographic light-sensitive material of the present invention may contain therein hydroquinone derivatives, aminophenol derivatives, gallic acid derivatives, ascorbic acid derivatives, etc., as color fog preventing agents. Specific examples thereof are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese patent application (OPI) Nos. 92988/75, 92989/75, 93928/75, 110337/75 and 146235/77, Japanese patent publication No. 23813/75, etc.

To the color photographic light-sensitive material of the present invention, various kinds of photographic additives known in this field, for example, stabilizers, antifoggants, surface active agents, couplers other than the present invention, filter dyes, irradiation preventing dyes, developing agents can be added in addition to the above described compounds, if desired. Typical examples of such additives are described in *Research Disclosure,* No. 17643 (December, 1978).

A color developing solution used in the present invention is preferably an alkaline aqueous solution containing an aromatic primary amine color developing agent as a main component. As a color developing agent, a p-phenylenediamine type compound is preferably used while an aminophenol type compound is useful. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or a sulfate, hydrochloride or p-toluenesulfonate thereof, etc. These diamines are preferably employed in the form of salts since the salts are generally more stable than their free forms.

The color developing solution generally contains pH buffering agents such as carbonates, borates or phosphates of alkali metals, etc., development inhibitors or antifogging agents such as bromides, iodides, benzimidazoles, benzothiazoles or mercapto compounds, etc. In addition, if desired, the color developing solution may also contain preservatives such as hydroxylamine sulfites, etc.; organic solvents such as triethanolamine, diethylene glycol, etc.; development accelerators such as benzyl alcohol, polyethylene glycol, quaternary ammonium salts, amines, etc.; dye forming couplers; competing couplers; nucleating agents such as sodium borohydride, etc.; auxiliary developing agents such as 1-phenyl-3-pyrazolidone, etc.; viscosity-imparting agents; various chelating agents such as aminopolycarboxylic acids, aminopolyphosphonic acids, alkylphosphonic acids, phosphonocarboxylic acids, etc.; antioxidants as described in West German patent application (OLS) No. 2,622,950; and the like.

In the case of development processing of color reversal photographic light-sensitive materials, it is conventional to carry out black and white development before color development. In a black and white developing solution, a known black and white developing agent, for example, a dihydroxybenzene such as hydroquinone, etc., a 3-pyrazolidone such as 1-phenyl-3-pyrazolidone, etc., or an aminophenol such as N-methyl-p-aminophenol, etc. may be employed individually or in combination thereof.

After color development, the photographic emulsion layer is usually subjected to a bleach processing. The bleach processing may be performed simultaneously with a fix processing, or they may be performed independently.

Bleaching agents which can be used include compounds of polyvalent metals, for example, iron (III), cobalt (III), chromium (VI), and copper (II), peracids, quinones and nitroso compounds. For example, ferricyanides; dichromates; organic complex salts of iron (III) or cobalt (III), for example, complex salts of aminopolycarboxylic acids (e.g., ethylenediaminetetraacetic acid, diethylenetriaminepentaacetic acid, nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc. can be typically used. Of these compounds, iron (III) salts of ethylenediaminetetraacetic acid and persulfates are preferred in view of rapid processing and prevention from environmental pollution. Further, ethylenediaminetetraacetic acid iron (III) complex salts are particularly useful in both an independent bleaching solution and a mono-bath bleach-fixing solution.

In the bleaching solution or the bleach-fixing solution, various kinds of accelerators may be employed together, if desired. For example, bromide ions, iodide ions, thiourea type compounds as described in U.S. Pat. No. 3,706,561, Japanese patent publication Nos. 8506/70 and 26586/74, Japanese patent application (OPI) Nos. 32735/78, 36233/78 and 37016/78, etc., thiol type compounds as described in Japanese patent application (OPI) Nos. 124424/78, 95631/78, 57831/78, 32736/78, 65732/78 and 52534/79, U.S. Pat. No. 3,893,858, etc., heterocyclic compounds as described in Japanese patent application (OPI) Nos. 59644/74, 140129/75, 28426/78, 141623/78, 104232/78 and 35727/79, etc., thioether type compounds as described in Japanese patent application (OPI) Nos. 20832/77, 25064/80 and 26506/80, etc., tertiary amines as described in Japanese patent application (OPI) No. 84440/73, etc., thiocarbamoyls as described in Japanese patent application (OPI) No. 42349/74, etc., and the like may be employed individually or in combination of two or more thereof.

Of these compounds bromide ions, iodide ions, thiol type compounds or disulfide type compounds are preferred bleach accelerators.

In the case of bleach-fixing color photographic light-sensitive materials for photographing, such bleach accelerators are particularly effective.

Examples of the fixing agents include thiosulfates, thiocyanates, thioether type compounds, thioureas, a large amount of iodides, etc. Of these compounds, thiosulfates are generally employed. As preservatives for the bleach-fixing solution or the fixing solution, sulfites, bisulfites and carbonyl bisulfite adducts are preferably employed.

After the bleach-fixing processing or the fixing processing, water washing processing is usually carried out. In the water washing step, various known compounds may be employed for the purpose of preventing precipitation or saving water, etc. For example, a water softener such as an inorganic phosphoric acid, an aminopolycarboxylic acid or an organic phosphoric acid, etc.; a sterilizer or antimold for preventing the propagation of various bacteria, algae and molds; a hardening agent such as a magnesium salt or an aluminium salt, etc.; or a surface active agent for reducing drying load or preventing drying marks, or the like may be added, if desired. Further, the compounds as described in L. E. West, "Water Quality Criteria" in *Photo. Sci. and Eng.*, Vol. 6, pages 344 to 359 (1965) may be added. Particularly, the addition of chelating agents and antimolds is effective.

The water washing step is ordinarily carried out using a countercurrent water washing processing with two or more tanks in order to save water. Further, in place of the water washing step, a multi-stage countercurrent stabilizing processing step as described in Japanese patent application (OPI) No. 8543/82 may be conducted. In this step two to nine tanks of countercurrent baths are necessary. To the stabilizing bath various kinds of compounds are added for the purpose of stabilizing images formed. Representative examples of the additives include various buffers (for example, borates, methaborates, borax, phosphates, carbonates, potassium hydrooxide, sodium hydroxide, aqueous ammonia, monocarboxylic acids, dicarboxylic acids, polycarboxylic acids, etc. being used in combination) for the purpose of adjusting the pH of layers (for example, pH of 3 to 8), and formalin, etc. In addition, various additives, for example, water softeners (for example, inorganic phosphoric acids, aminopolycarboxylic acids, organic phosphoric acids, aminopolyphosphonic acids, phosphonocarboxylic acids, etc.), sterilizers (for example, benzoisothiazolinones, isothiazolones, 4-thiazolinebenzimidazoles, halogenated phenols, etc.), surface active agents, fluorescent whitening agents, hardening agents, etc. may be employed, if desired. Two or more compounds for the same or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as pH adjusting agent for layers after processing.

For the purpose of simplification and acceleration of processing, a color developing agent may be incorporated into the silver halide color photographic material. In order to incorporate the color developing agent, it is preferred to employ various precursors of color developing agents. Suitable examples of the precursors include indoaniline type compounds as described in U.S. Pat. No. 3,342,597, Schiff's base type compounds as described in U.S. Pat. No. 3,342,599 and *Research Disclosure*, No. 14850 (August, 1976), and ibid., No. 15159 (November, 1976), aldol compounds as described in *Research Disclosure*, No. 13924 (November, 1975), metal salt complexes as described in U.S. Pat. No. 3,719,492, urethane type compounds as described in Japanese patent application (OPI) No. 135628/78, and various salt type precursors as described in Japanese patent application (OPI) No. 6235/81, 16133/81, 59232/81, 67842/81, 83734/81, 83735/81, 83736/81, 89735/81, 81837/81, 54430/81, 106241/81, 107236/81, 97531/82 and 83565/82, etc.

Further, the silver halide color photographic material of the present invention may contain various 1-phenyl-3-pyrazolidones for the purpose of accelerating color development, if desired. Typical examples of the compounds are described in Japanese patent application (OPI) Nos. 64339/81, 144547/82, 211147/82, 50532/83, 50536/83, 50533/83, 50534/83, 50535/83 and 115438/83, etc.

Various kinds of processing solutions are employed in a temperature range from 10° C. to 50° C. in the present invention. Although a temperature range from 33° C. to 38° C. is ordinarily utilized, it is possible to carry out the processing at higher temperatures in order to accelerate the processing whereby the processing time is shortened, or at lower temperatures for the purpose of accomplishing improved image quality or improvement in stability of the processing solutions.

Moreover, the photographic processing may be conducted utilizing color intensification using cobalt or hydrogen peroxide as described in West German patent application (OLS) No. 2,226,770 and U.S. Pat. No. 3,674,499, etc. for the purpose of saving an amount of silver employed in the photographic material.

The present invention is described in greater detail with reference to the following examples, but the present invention is not to be construed as being limited thereto. Unless otherwise specified, all present, ratios, etc. are by weight.

EXAMPLE 1

On a cellulose triacetate film support were coated a green-sensitive emulsion layer and a protective layer each having the composition set forth below to prepare a photographic light-sensitive material, which was designated Sample 101.

| | |
|---|---|
| First Layer: Red-Sensitive Emulsion Layer | |
| Silver iodobromide emulsion (silver iodide: 8 mol %), silver coated amount: | 1.5 g/m$^2$ |
| Sensitizing Dye I | $3 \times 10^{-4}$ mol per mol of silver |
| Sensitizing Dye II | $1.5 \times 10^{-4}$ mol per mol of silver |
| Coupler EX-1 | 0.02 mol per mol of silver |
| Second Layer: Protective Layer | |
| A gelatin layer containing polymethyl methacrylate particles (having a diameter of about 2.5 μm), gelatin coated amount: | 1.0 g/m$^2$ |

Gelatin Hardener H-1 and a surface active agent were added to each of the layers in addition to the above described components.

Samples 102 to 104 were prepared in the same manner as described for Sample 101 except using Polymer Couplers (A), (B) and (C), respectively, in place of Coupler EX-1 in the first layer of Sample 101 in an amount so as to be equal in the molar amount of the color forming unit portion to the coupler EX-1.

The compounds used for preparing the samples were as follows:

Sensitizing Dye I: Sodium salt of anhydro-9-ethyl-5,5'-dichloro-3,3'-di(δ-sulfopropyl)oxacarbocyanine Sensitizing Dye II: Sodium salt of anhydro-5,6,5',6'-tetrachloro-1,1'-diethyl-3,3'-di{β-[β-(δ-sulfopropoxy)ethoxy]ethyl}imidazolocarbocyanine hydroxide Coupler EX-1:

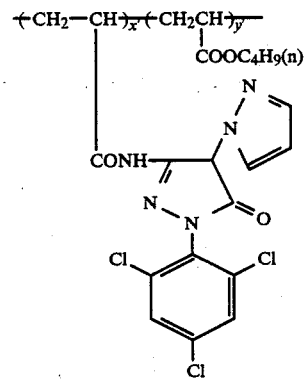

wherein x'/y'=50/50 (in weight ratio) [the compound as described in Japanese patent application (OPI) No. 94752/82]

Gelatin Hardener H-1:

$(CH_2{=}CHSO_2CH_2CONHCH_2)_2$

Samples 101 to 104 thus prepared were subjected to sensitometric exposure and then color development processing at 38° C. using the following processing steps.

| Processing Step | Time |
|---|---|
| Color development | 3 min 15 sec |
| Bleaching | 6 min 30 sec |
| Washing with water | 2 min 10 sec |
| Fixing | 4 min 20 sec |
| Washing with water | 3 min 15 sec |
| Stabilizing | 1 min 05 sec |

The processing solutions used in the color development processing had the following compositions:

| | | |
|---|---|---|
| Color Developing Solution | | |
| Diethylenetriaminepentaacetic Acid | 1.0 | g |
| 1-Hydroxyethylidene-1,1-diphosphonic Acid | 2.0 | g |
| Sodium Sulfite | 4.0 | g |
| Potassium Carbonate | 30.0 | g |
| Potassium Bromide | 1.4 | g |
| Potassium Iodide | 1.3 | mg |
| Hydroxylamine Sulfate | 2.4 | g |
| 4-(N-Ethyl-N-β-hydroxyethylamino)-2-methylaniline Sulfate | 4.5 | g |
| Water to make | 1.0 | liter |
| pH | 10.0 | |

-continued

| | | |
|---|---|---|
| Bleaching Solution | | |
| Iron (III) Ammonium Ethylenediaminetetraacetate | 100.0 | g |
| Disodium Ethylenediaminetetraacetate | 10.0 | g |
| Ammonium Bromide | 150.0 | g |
| Ammonium Nitrate | 10.0 | g |
| Water to make | 1.0 | liter |
| pH | 6.0 | |
| Fixing Solution | | |
| Disodium Ethylenediaminetetraacetate | 1.0 | g |
| Sodium Sulfite | 4.0 | g |
| Ammonium Thiosulfate (70% aq. soln.) | 175.0 | ml |
| Sodium Bisulfite | 4.6 | g |
| Water to make | 1.0 | liter |
| pH | 6.6 | |
| Stabilizing Solution | | |
| Formalin (40%) | 2.0 | ml |
| Polyoxyethylene-p-monononylphenyl-ether (average degree of polymerization = about 10) | 0.3 | g |
| Water to make | 1.0 | liter |

The results thus obtained are shown in Table 1.

TABLE 1

| Sample | Polymer Coupler | Oil pKa' | Fog | Relative[1] Sensitivity | Maximum Color Density |
|---|---|---|---|---|---|
| 101 | EX-1 (Comparison) | 7.4 | 0.05 | 100 | 2.51 |
| 102 | (A) (Present Invention) | 8.5 | 0.05 | 106 | 2.91 |
| 103 | (B) (Present Invention) | 9.0 | 0.05 | 112 | 3.25 |
| 104 | (C) (Present Invention) | 8.7 | 0.05 | 115 | 3.08 |

[1]The sensitivity is shown by a reciprocal of the exposure amount required for obtaining an optical density of fog +0.2 and the sensitivity of Sample 101 is taken as 100 and the other sensitivities are shown relatively.

It is apparent from the results shown in Table 1 that the polymer couplers according to the present invention exhibit high activity and a higher color forming property.

EXAMPLE 2

On a cellulose triacetate film support provided with a subbing layer were coated layers having the compositions set forth below to prepare a multilayer color photographic light-sensitive material, which was designated Sample 201.

With the compositions of the layers, coated amounts of silver halide and colloidal silver are shown by a silver coated amount in a unit of g/m², those of couplers, additives and gelatin are shown using a unit of g/m², and those of sensitizing dyes are shown using a molar amount per mol of silver halide present in the same layer.

| | |
|---|---|
| First Layer: Antihalation Layer | |
| Black colloidal silver | 0.2 |
| Gelatin | 1.3 |
| Ultraviolet Ray Absorbing Agent UV-1 | 0.1 |
| Ultraviolet Ray Absorbing Agent UV-2 | 0.2 |
| Dispersion Oil Oil-1 | 0.01 |
| Dispersion Oil Oil-2 | 0.01 |
| Second Layer: Intermediate Layer | |
| Fine grain silver bromide (average particle size: 0.07μ) | 0.15 |
| Gelatin | 1.0 |

-continued

| | |
|---|---|
| Colored Coupler C-1 | 0.1 |
| Colored Coupler C-2 | 0.01 |
| Dispersion Oil Oil-1 | 0.1 |
| Third Layer: First Red-Sensitive Emulsion Layer | |
| Silver iodobromide emulsion (silver iodide: 3 mol %, average particle size: 0.3μ) | 1.6 (silver) |
| Gelatin | 1.6 |
| Sensitizing Dye I | $4.5 \times 10^{-4}$ |
| Sensitizing Dye II | $1.5 \times 11^{-4}$ |
| Coupler C-3 | 0.30 |
| Coupler C-4 | 0.40 |
| Coupler C-5 | 0.02 |
| Coupler C-2 | 0.003 |
| Dispersion Oil Oil-1 | 0.03 |
| Dispersion Oil Oil-3 | 0.012 |
| Fourth Layer: Second Red-Sensitive Emulsion Layer | |
| Silver iodobromide emulsion (silver iodide: 6 mol %, average particle size: 0.7μ) | 1.0 (silver) |
| Gelatin | 1.0 |
| Sensitizing Dye I | $3 \times 10^{-4}$ |
| Sensitizing Dye II | $1 \times 10^{-4}$ |
| Coupler C-6 | 0.05 |
| Coupler C-7 | 0.015 |
| Coupler C-2 | 0.0 |
| Dispersion Oil Oil-1 | 0.01 |
| Dispersion Oil Oil-2 | 0.05 |
| Fifth Layer: Intermediate Layer | |
| Gelatin | 1.0 |
| Compound Cpd-A | 0.03 |
| Dispersion Oil Oil-1 | 0.05 |
| Dispersion Oil Oil-2 | 0.05 |
| Sixth Layer: First Green-Sensitive Emulsion Layer | |
| Silver iodobromide emulsion (silver iodide: 4 mol %, average particle size: 0.3μ) | 0.8 (silver) |
| Sensitizing Dye III | $5 \times 10^{-4}$ |
| Sensitizing Dye IV | $2 \times 10^{-4}$ |
| Gelatin | 1.0 |
| Coupler C-8 | 0.3 |
| Coupler C-5 | 0.06 |
| Coupler C-1 | 0.15 |
| Dispersion Oil Oil-1 | 0.5 |
| Seventh Layer: Second Green-Sensitive Emulsion Layer | |
| Silver iodobromide emulsion (silver iodide: 6 mol %, average particle size: 0.7μ) | 0.85 (silver) |
| Gelatin | 1.0 |
| Sensitizing Dye III | $3.5 \times 10^{-4}$ |
| Sensitizing Dye IV | $1.4 \times 10^{-4}$ |
| Coupler C-10 | 0.05 |
| Coupler C-11 | 0.01 |
| Coupler C-12 | 0.08 |

-continued

| | |
|---|---|
| Coupler C-1 | 0.02 |
| Coupler C-9 | 0.02 |
| Dispersion Oil Oil-1 | 0.10 |
| Dispersion Oil Oil-2 | 0.05 |
| Eighth Layer: Yellow Filter Layer | |
| Gelatin | 1.2 |
| Yellow colloidal silver | 0.08 |
| Compound Cpd-B | 0.1 |
| Dispersion Oil Oil-1 | 0.3 |
| Ninth Layer: First Blue-Sensitive Emulsion Layer | |
| Monodispersed silver iodobromide emulsion (silver iodide: 4 mol %, average particle size: 0.3μ) | 0.4 (silver) |
| Gelatin | 1.0 |
| Sensitizing Dye V | $2 \times 10^{-4}$ |
| Coupler C-13 | 0.9 |
| Coupler C-5 | 0.07 |
| Dispersion Oil Oil-1 | 0.2 |
| Tenth Layer: Second Blue-Sensitive Emulsion Layer | |
| Silver iodobromide emulsion (silver iodide: 10 mol %, average particle size: 1.5μ) | 0.5 (silver) |
| Gelatin | 0.6 |
| Sensitizing Dye V | $1 \times 10^{-4}$ |
| Coupler C-14 | 0.25 |
| Dispersion Oil Oil-1 | 0.07 |
| Eleventh Layer: First Protective Layer | |
| Gelatin | 0.8 |
| Ultraviolet Ray Absorbing Agent UV-1 | 0.1 |
| Ultraviolet Ray Absorbing Agent UV-2 | 0.2 |
| Dispersion Oil Oil-1 | 0.01 |
| Dispersion Oil Oil-2 | 0.0 |
| Twelfth Layer: Second Protective Layer | |
| Fine grain silver bromide (average particle size: 0.07μ) | 0.5 |
| Gelatin | 0.45 |
| Polymethyl methacrylate particle (diameter: 1.5μ) | 0.2 |
| Hardening Agent H-1 | 0.4 |
| Formaldehyde Scavenger S-1 | 1.0 |

A surface active agent was added to each of the layers as a coating aid in addition to the above described components.

Samples 202 and 203 were prepared in the same manner as described for Sample 201 except using Polymer Coupler (A) and (B), respectively, in place of Coupler C-8 in the sixth layer of Sample 201 in an amount so as to be equal in the molar amount of the color forming unit portion to the Coupler C-8.

The compounds used for preparing the samples were as follows:

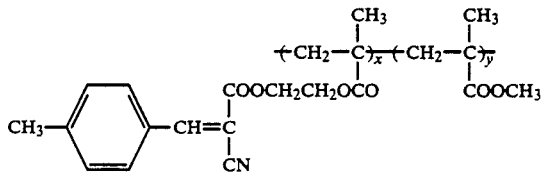

UV-1 wherein x/y = 7/3 (in weight ratio)

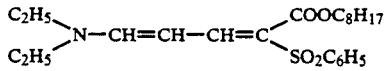

Tricresyl phosphate — Oil-1

Dibutyl phthalate — Oil-2

Bis(2-ethylhexyl)phthalate — Oil-3

-continued
C-1
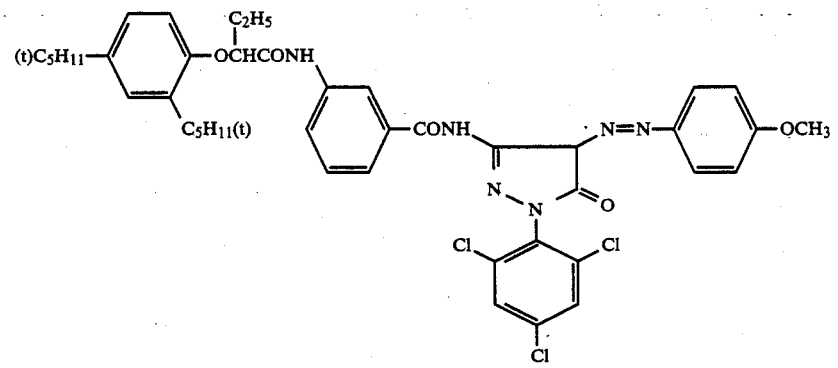
C-2
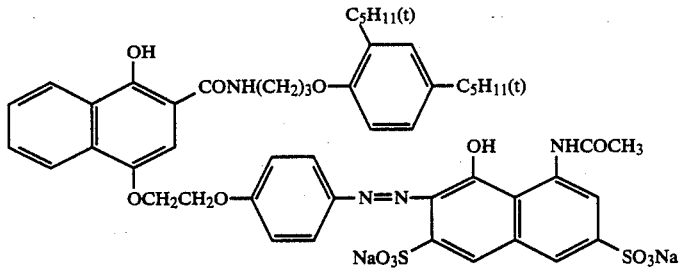
C-3
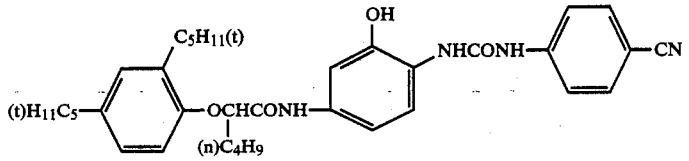
C-4
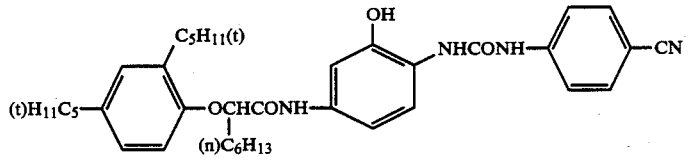
C-5
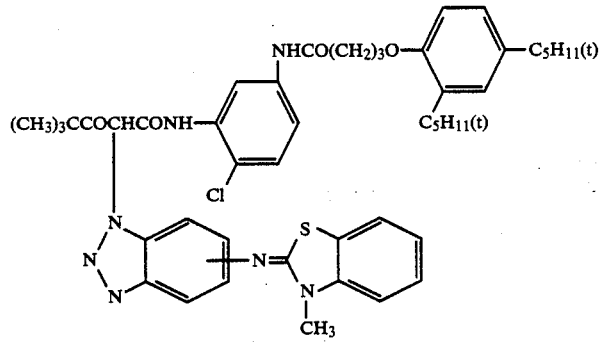

-continued
C-6
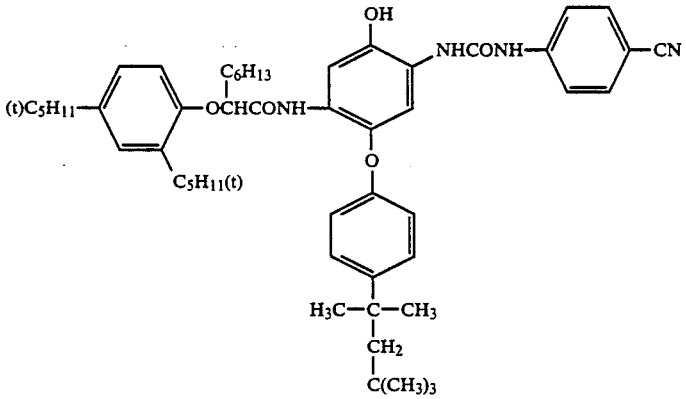
C-7
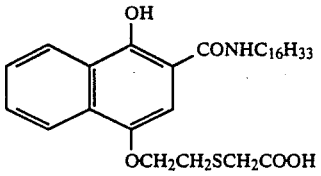
(Compound described in Japanese Patent Application (OPI) 94752/82)
C-8
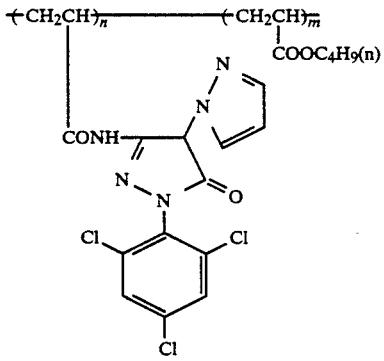
n/m = 1 (wt. ratio)
C-9
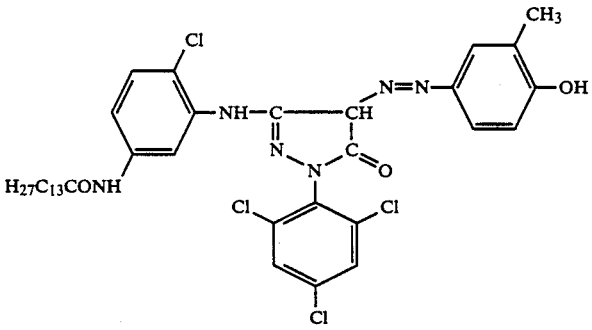
C-10
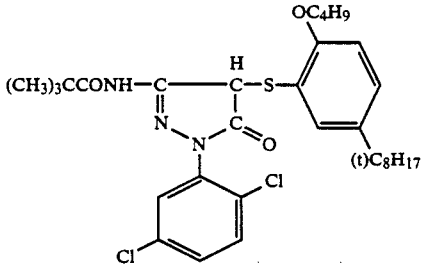

-continued
C-11
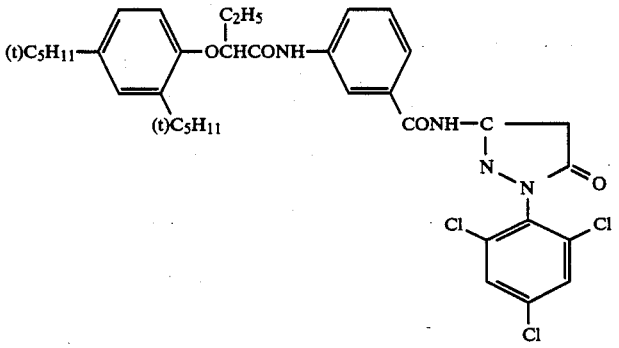
C-12
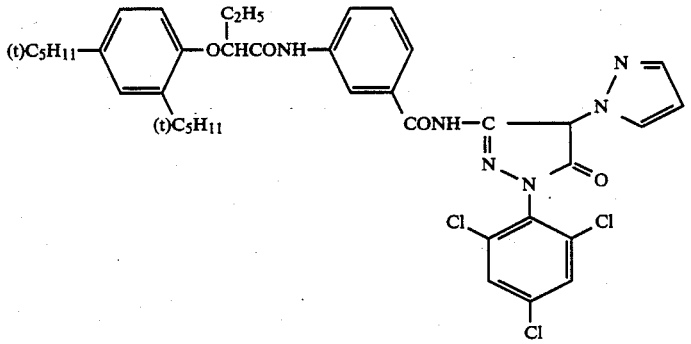
C-13
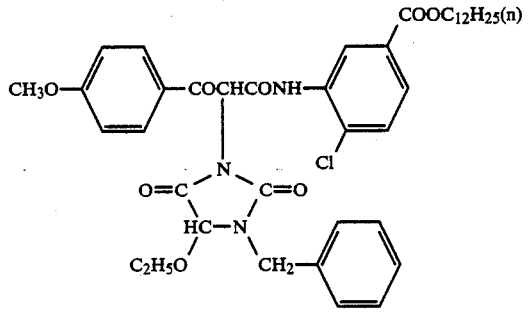
C-14 is set forth in Example 3
Cpd A
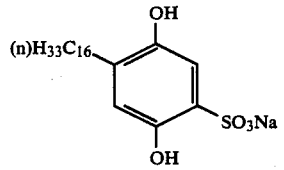
Cpd B
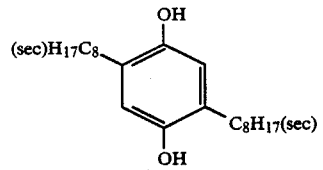
Sensitizing Dye I
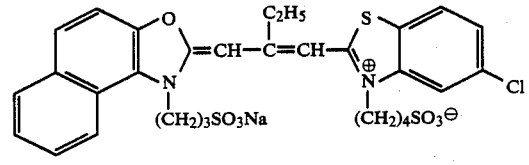

-continued

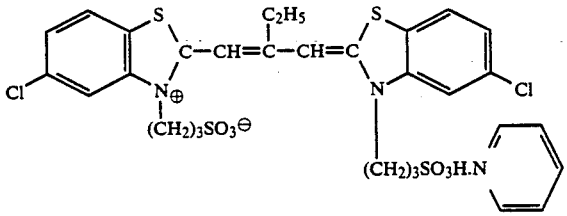

Sensitizing Dye II

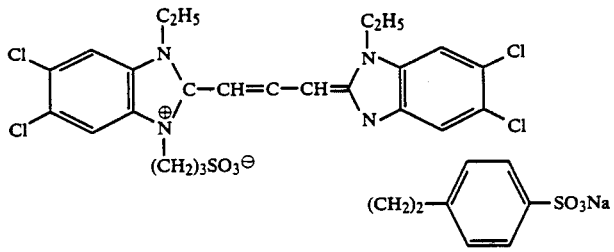

Sensitizing Dye III

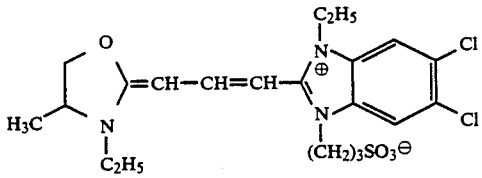

Sensitizing Dye IV

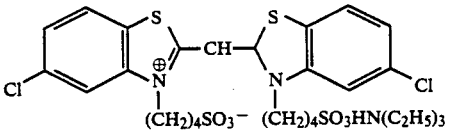

Sensitizing Dye V

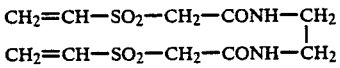

H-1

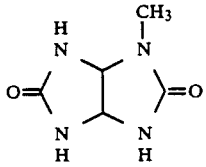

S-1

Samples 201 to 203 thus prepared were exposed to light at 25 CMS adjusted at a color temperature of 4,800° K. by a filter using a tungsten light source and then subjected to the same color development processing as described in Example 1.

Further, Samples 201 to 203 were subjected to a durability test at 45° C. and 80% RH for 3 days and then exposure to light and development processing in the same manner as described above. From the results thus obtained, the increase in fog due to the durability test was determined by comparing the fog value in the sample subjected to the durability test and that in the fresh sample. The results are shown in Table 2.

TABLE 2

| Sample | Main Coupler in Sixth Layer | Increase in Fog by Durability Test |
|---|---|---|
| 201 | C-8 (Comparison) | 0.08 |
| 202 | (A) (Present Invention) | 0.01 |
| 203 | (B) (Present Invention) | 0.01 |

It is apparent from the results shown in Table 2 that the increase in fog by the durability test under high temperature and high humidity conditions is remarkably restrained with samples 202 and 203 in which the polymer couplers according to the present invention are employed.

EXAMPLE 3

Samples 301 to 306 were prepared in the same manner as described for Sample 202 except using the equimolar amount of the coupler shown in Table 3 below in place of DIR Coupler C-5 in the sixth layer of Sample 202, respectively.

These samples were subjected to a durability test under the condition of 45° C. and 70% RH for one month and then exposure to light and development processing in the same manner as described in Example 2.

The fog values thus obtained are shown in Table 3.

TABLE 3

| Sample | Polymer Coupler in Sixth Layer | DIR Coupler in Sixth Layer | Increase in* Fog by Durability Test |
|---|---|---|---|
| 201 (Comparison) | C-8 | C-5 | 0.24 |

TABLE 3-continued

| Sample | Polymer Coupler in Sixth Layer | DIR Coupler in Sixth Layer | Increase in* Fog by Durability Test |
|---|---|---|---|
| 202 (Present Invention) | (A) | C-5 | 0.09 |
| 203 (Present Invention) | (B) | C-5 | 0.06 |
| 301 (Present Invention) | (A) | C-14 | 0.10 |
| 302 (Present Invention) | " | (2) | 0.02 |
| 303 (Present Invention) | " | (3) | 0.03 |
| 304 (Present Invention) | " | C-14 | 0.02 |
| 203 (Present Invention) | (B) | (2) | 0.03 |
| 305 (Present Invention) | " | C-14 | 0.03 |
| 306 (Comparison) | C-8 | (2) | 0.14 |

*Difference in fog between the sample subjected to the durability test at 45° C. and 70% RH for one month and the sample stored in a refrigerator for one month.

DIR Coupler C-14:

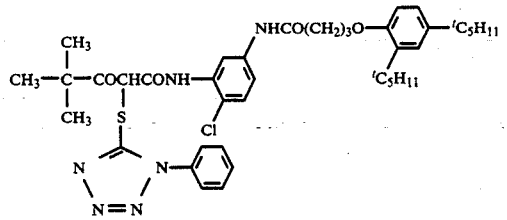

From the results shown in Table 3 it is understood that the increase in fog during preservation for a long time under the severe condition is remarkably restrained by the combination of the polymer coupler and the DIR coupler according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon a silver halide emulsion layer, wherein the silver halide color photographic material contains:

(a) a two-equivalent magenta polymer coupler which is capable of forming a color image upon coupling with an oxidation product of an aromatic primary amine developing agent and has an oil pKa' of 8.0 or more, wherein the two-equivalent magenta polymer coupler comprises a monomer coupler represented by the following general formula (II):

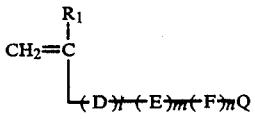

(II)

wherein $R_1$ represents a hydrogen atom, an alkyl group containing from 1 to 4 carbon atoms or a chlorine atom; D represents —COO—, —$CONR_2$— or a substituted or unsubstituted phenyl group; E represents a substituted or unsubstituted alkylene group, a substituted or unsubstituted phenylene group or a substituted or unsubstituted aralkylene group; F represents —$CONR_2$—, —$NR_2CONR_2$— —$NR_2COO$—, —$NR_2CO$—, —$OCONR_2$—, —$NR_2$—, —COO—, —OCO—, —CO—, —O—, —0—, —S—, —$SO_2$—, —$NR_2SO_2$— or —$SO_2NR_2$—; $R_2$ represents a hydrogen atom, a substituted or unsubstituted aliphatic group or a substituted or unsubstituted aryl group, and when two or more $R_2$s' are present in the same molecule, they may be the same or different; l, m and n are not 0 at the same time, and Q represents a coupler residue of a two-equivalent 2-pyrazolin-5-one type magenta coupler, and (b) a hydrolyzable type DIR coupler.

2. A silver halide color photographic material as claimed in claim 1, wherein the coupler residue represented by Q is derived from a two-equivalent 2-pyrazolin-5-one type magenta coupler represented by the following general formula (III):

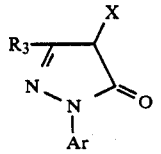

(III)

wherein Ar represents an alkyl group, a substituted alkyl group, a heterocyclic group, a substituted heterocyclic group, an aryl group or a substituted aryl group; $R_3$ represents an unsubstituted or substituted anilino group, an unsubstituted or substituted acylamino group, an unsubstituted or substituted ureido group or an unsubstituted or substituted sulfonamido group; and X represents a halogen atom, a coupling releasing group connected through an oxygen atom, a coupling releasing group connected through a nitrogen atom or a coupling releasing group connected through a sulfur atom.

3. A silver halide color photographic material as claimed in claim 2, wherein a substituent for the substituted aryl group and the substituted heterocyclic group represented by Ar is an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group, or a halogen atom.

4. A silver halide color photographic material as claimed in claim 2, wherein a substituent for the substituted anilino group, the substituted acylamino group, the substituted ureido group or the substituted sulfonamido group represented by $R_3$ is a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxy group, a sulfo group, a hydroxy group or a trichloromethyl group.

5. A silver halide color photographic material as claimed in claim 1, wherein the alkylene group represented by E is an alkylene group having from 1 to 10 carbon atoms.

6. A silver halide color photographic material as claimed in claim 1, wherein a substituent for the substituted alkylene group, the substituted aralkylene group or the substituted phenylene group represented by E is an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group or a sulfonyl group.

7. A silver halide color photographic material as claimed in claim 1, wherein the two-equivalent magenta polymer coupler is a copolymer.

8. A silver halide color photographic material as claimed in claim 7, wherein the copolymer consists of at least one of the monomer couplers represented by the general formula (II) as defined in claim 1 and at least one of non-color forming ethylenic monomers which do not couple with the oxidation product of an aromatic primary amine developing agent.

9. A silver halide color photographic material as claimed in claim 8, wherein the non-color forming monomer is selected from an acrylic acid ester, a methacrylic acid ester, a crotonic acid ester, a vinyl ester, a maleic acid diester, a fumaric acid diester, an itaconic acid diester, an acrylamide, a methacrylamide, a vinyl ether and a styrene.

10. A silver halide color photographic material as claimed in claim 8, wherein the non-color forming monomer is selected from an allyl compound, a vinyl ketone, a vinyl heterocyclic compound, a glycidyl ester, an unsaturated nitrile, acrylic acid, methacrylic acid, itaconic acid, maleic acid, an itaconic acid monoalkyl ester, a maleic acid monoalkyl ester, citraconic acid, vinyl sulfonic acid, an acryloyloxyalkylsulfonic acid and an acrylamidoalkylsulfonic acid.

11. A silver halide color photographic material as claimed in claim 1, wherein the polymer coupler contains a non-color forming portion and a color forming portion corresponding to the monomer coupler of general formula (II), and the amount of the color forming portion in the polymer coupler is from 5% to 80% by weight.

12. A silver halide color photographic material as claimed in claim 11, wherein the amount of the color forming portion in the polymer coupler is from 30% to 70% by weight.

13. A silver halide color photographic material as claimed in claim 1, wherein the gram number of the polymer containing 1 mol of a monomer coupler is from 250 to 4,000.

14. A silver halide color photographic material as claimed in claim 1, wherein the two-equivalent magenta polymer coupler is present in a silver halide emulsion layer or in an adjacent layer thereto.

15. A silver halide color photographic material as claimed in claim 1, wherein the hydrolyzable type DIR coupler is a DIR coupler capable of releasing a development inhibitor, a half-value period of which at pH 10.0 is 4 hour or less.

16. A silver halide color photographic material as claimed in claim 15, wherein the hydrolyzable type DIR coupler is represented by the following general formula (IV):

$$A-[(L_1)_a-Z-(L_2-Y)_b]_p \quad (IV)$$

wherein A represents a coupler component; Z represents a fundamental portion of a compound having a development inhibiting function which is connected directly (when a is 0) or through a linking group $L_1$ (when a is 1) with the coupling position of the coupler; Y is connected with Z through a linking group $L_2$ and represents a substituent capable of generating the development inhibiting function of Z; $L_1$ represents a linking group; $L_2$ represents a linking group including a chemical bond which is cut in a developing solution; a represents 0 to 1; b represents 1 or 2, two-$L_2$—Y's may be the same or different; and p represents 1 or 2.

17. A silver halide color photographic material as claimed in claim 16, wherein the fundamental portion represented by Z is a divalent nitrogen-containing heterocyclic group or a nitrogen-containing heterocyclic thio group.

18. A silver halide color photographic material as claimed in claim 16, wherein the substituent represented by Y is an alkyl group, a cycloalkyl group, an alkenyl group, a cycloalkenyl group, an aryl group, an aralkyl group or a heterocyclic group.

19. A silver halide color photographic material as claimed in claim 1, wherein the color photographic material further contains a non-hydrolyzable type DIR coupler which is represented by the following general formula (I):

$$A-(L_1)_a-Z_1 \quad (I)$$

wherein A represents a component capable of releasing $-(L_1)_a-Z_1$ upon a reaction with an oxidation product of a color developing agent; $L_1$ represents a timing group; $Z_1$ represents a development inhibiting component which is not deactivated upon hydrolysis; and a represents 0 or 1.

20. A silver halide color photographic material as claimed in claim 19, wherein A and $(L_1)_a$ each has the same meaning as defined in claim 18, and $Z_1$ represents a development inhibiting component, a development inhibitor of which is not hydrolyzed in a color developing solution.

21. A silver halide color photographic material as claimed in claim 20, wherein the development inhibitor contained in $Z_1$ is a mercaptotetrazole, a mercaptobenzothiazole, a mercaptobenzoxazole, a mercaptobenzimidazole, a benzotriazole, a benzodiazole or a derivative thereof.

22. A silver halide color photographic material as claimed in claim 16, wherein the two-equivalent magenta polymer coupler and the hydrolyzable type DIR coupler are present in the same silver halide emulsion layer.

23. A silver halide color photographic material as claimed in claim 19, wherein the two-equivalent magenta polymer coupler and the non-hydrolizable type DIR coupler are present in the same silver halide emulsion layer.

* * * * *